US010680367B2

(12) United States Patent
Cheng et al.

(10) Patent No.: US 10,680,367 B2
(45) Date of Patent: Jun. 9, 2020

(54) CABLE RETENTION ASSEMBLIES INCLUDING TORSIONAL ELEMENTS

(71) Applicant: Intel Corporation, Santa Clara, CA (US)

(72) Inventors: Feifei Cheng, Chandler, AZ (US); Kuang C. Liu, Queen Creek, AZ (US); Michael Garcia, Mesa, AZ (US); Eric W. Buddrius, DuPont, WA (US); Kevin J. Ceurter, Olympia, WA (US); Anthony P. Valpiani, Olympia, WA (US); Jonathon Robert Carstens, Lacey, WA (US)

(73) Assignee: Intel Corporation, Santa Clara, CA (US)

( * ) Notice: Subject to any disclaimer, the term of this patent is extended or adjusted under 35 U.S.C. 154(b) by 821 days.

(21) Appl. No.: 15/084,682

(22) Filed: Mar. 30, 2016

(65) Prior Publication Data

US 2017/0288330 A1 Oct. 5, 2017

(51) Int. Cl.
*H01R 12/75* (2011.01)
*H01R 12/77* (2011.01)
(Continued)

(52) U.S. Cl.
CPC ..... *H01R 12/75* (2013.01); *H01R 12/7023* (2013.01); *H01R 12/774* (2013.01); *H01R 13/62* (2013.01); *H01R 13/639* (2013.01)

(58) Field of Classification Search
CPC .. H01R 4/50; H01R 12/7005; H01R 12/7011; H01R 12/7017; H01R 12/7023;
(Continued)

(56) References Cited

U.S. PATENT DOCUMENTS 5,211,566 A * 5/1993 Bates ..... G11B 33/122 361/679.41
6,383,000 B1 5/2002 Burd et al.
(Continued)

FOREIGN PATENT DOCUMENTS

CN 2697900 5/2005
CN 200972919 11/2007
(Continued)

OTHER PUBLICATIONS

USPTO Non-Final Office Action issued in U.S. Appl. No. 15/084,726 dated Mar. 24, 2017; 13 pages.
(Continued)

*Primary Examiner* — Travis S Chambers
(74) *Attorney, Agent, or Firm* — Patent Capital Group

(57) ABSTRACT

Embodiments of the disclosure are directed to a linear edge connector assembly for connecting to a substrate diving board of a mother board. The linear edge connector assembly can include an electrical interface to electrically connect the contacts on the diving board to one or more conducts of a cable bundle. The linear edge connector assembly can also include a retaining force mechanism. The retaining force mechanism can include a torsional spring, a spring loaded hooking mechanism, or a spring loaded cam and lever. In some embodiments, the linear edge connector can include a notch to receive a latch connected to a bolster plate on the mother board.

6 Claims, 22 Drawing Sheets

(51) Int. Cl.
*H01R 13/62* (2006.01)
*H01R 13/639* (2006.01)
*H01R 12/70* (2011.01)

(58) Field of Classification Search
CPC ..... H01R 12/7029; H01R 12/75; H01R 13/4361; H01R 13/62; H01R 13/625; H01R 13/6276; H01R 13/639; H01R 13/6392; H01R 12/72; H01R 13/629; H01R 13/62933; H01R 12/774
USPC ..... 439/78, 299, 345–372, 629, 630, 310, 439/325, 157, 327
See application file for complete search history.

(56) References Cited

U.S. PATENT DOCUMENTS

| | | | | |
|---|---|---|---|---|
| 6,415,168 | B1 | 7/2002 | Putz | |
| 6,830,472 | B1 | 12/2004 | Wu | |
| 7,160,126 | B1 | 1/2007 | Lai | |
| 7,189,098 | B1 | 3/2007 | Wu | |
| 7,367,823 | B2 | 5/2008 | Rapp et al. | |
| 7,467,948 | B2 | 12/2008 | Lindberg et al. | |
| 7,762,817 | B2 | 7/2010 | Ligtenberg et al. | |
| 8,241,065 | B2 * | 8/2012 | Ikari | H01R 12/775 439/372 |
| 9,825,387 | B2 * | 11/2017 | Cheng | H01R 13/639 |
| 2003/0198026 | A1 | 10/2003 | Bui | |
| 2004/0132331 | A1 | 7/2004 | Osborn et al. | |
| 2005/0020121 | A1 | 1/2005 | Lin et al. | |
| 2007/0287302 | A1 | 12/2007 | Lindberg et al. | |
| 2008/0232758 | A1 | 9/2008 | Miyoshi et al. | |
| 2009/0197431 | A1 | 8/2009 | Li et al. | |
| 2013/0188325 | A1 | 7/2013 | Garman et al. | |
| 2013/0252451 | A1 * | 9/2013 | Henry | G02B 6/4246 439/350 |
| 2014/0193994 | A1 * | 7/2014 | Miki | H01R 12/721 439/372 |
| 2015/0288117 | A1 | 10/2015 | Yeh | |
| 2015/0311635 | A1 * | 10/2015 | Yeh | H01R 12/716 439/370 |
| 2015/0357751 | A1 | 12/2015 | Gao et al. | |

FOREIGN PATENT DOCUMENTS

| | | | |
|---|---|---|---|
| CN | 201523097 | U | 7/2010 |
| CN | 101552410 | B | 3/2012 |
| CN | 202930651 | U | 5/2013 |
| EP | 0057255 | B1 | 1/1986 |
| JP | 2005189684 | A | 7/2005 |
| JP | 2015050033 | A | 3/2015 |
| JP | 9283218 | A | 4/2019 |
| WO | 2014123730 | A1 | 8/2014 |
| WO | 2017172189 | A1 | 10/2017 |

OTHER PUBLICATIONS

USPTO Restriction Requirement issued in U.S. Appl. No. 15/084,726 dated Jan. 11, 2017; 4 pages.
International Search Report and Written Opinion issued in International Application No. PCT/US2017/020023 dated Jun. 7, 2017; 13 pages.
International Search Report and Written Opinion issued in International Application No. PCT/US2017/020002 dated Aug. 18, 2017; 12 pages.
USPTO Notice of Allowance issued in U.S. Appl. No. 15/084,726 dated Jul. 12, 2017; 12 pages.
Extended European Search Report in EP Patent Application No. 17776196.2 dated Oct. 17, 2019, 7 pages.
Chinese first office action in Chinese Patent Application No. 201780013730.7 dated Nov. 4, 2019, 16 pages (and Explanation of Relevance).

* cited by examiner

CABLE RETENTION ASSEMBLIES INCLUDING TORSIONAL ELEMENTS

TECHNICAL FIELD

This disclosure pertains to linear edge connector retention mechanisms.

BACKGROUND

Linear Edge Connectors (LEC) are part of an Internal Faceplate-to-Processor (IFP) internal cable which enables high speed, low loss data direct connection from a processor to an fabric network. On one end of the IFP cable can be a 54-pin LEC that connects to a processor package. On the other end of the IFP cable, two 28-pins plugs can mate to Internal Faceplate Transition Connector (IFT connector).

The inherent nature of direct connection to a CPU board for LEC determines its fine contact pitch and tight tolerance, which differentiate LEC from other available edge connectors.

DETAILED DESCRIPTION

This disclosure describes embodiments of a linear edge connector (LEC) assembly for connecting a cable bundle to a substrate diving board that can carry a central processing unit and/or other computer component. In some embodiments, a bolster plate can include structural elements to provide structural support for connecting the LEC assembly to substrate diving board. Embodiments of the disclosure are also directed to securing the cable bundle to the LEC with sufficient force to prevent LEC electrical failure through shipping vibration induced fretting.

Retention mechanisms can add to functionality of Linear Edge Connector for fabric version of server products. For edge connectors, fretting corrosion is a common issue caused by micro-movement of the connector contact tip relative to substrate diving board pad under shipping/operational shock and shipping vibration conditions. It is a potential risk for connector electrical performance.

Figure 1A:
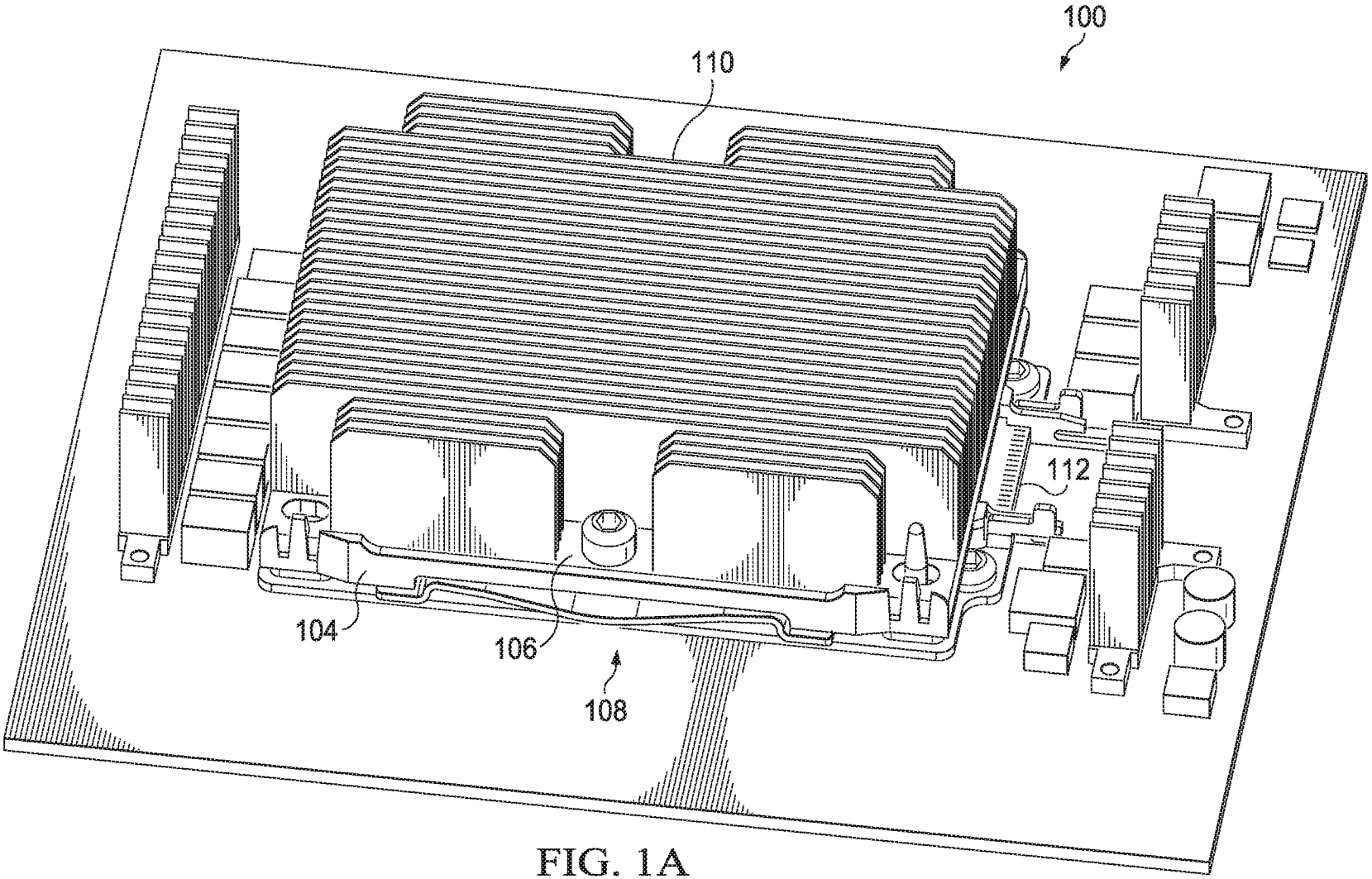
FIG. 1A is a schematic diagram of a system that includes a substrate diving board 112 and a bolster plate 104 in accordance with embodiments of the present disclosure.

FIG. 1A is a schematic diagram of a system 100 that includes a substrate diving board 112 and a bolster plate 104 in accordance with embodiments of the present disclosure. A substrate 106 (shown in FIG. 1B) can include a CPU (not shown) and secured by a Package Heatsink Loading Mechanism (PHLM) 107. The substrate 106 can include a substrate diving board 112 that provides an electrical interface to other computing or network elements. At the system stack level, the LEC assembly interacts with several key components in the system, e.g., substrate diving board 112 and bolster plate 104. The physical location of the interface between the LEC assembly and the substrate diving board is where dynamic (mechanical) inputs get magnified significantly. For example, in FIG. 1A, a substrate 108 is attached to a heat sink 110 (through the PHLM 107), which plays a big role in dynamic input. Also, to accommodate routing options for different system layouts and provide flexibility for customers, the cable bundle is not retained on the mother board which further magnifies the dynamic inputs on LEC assembly during shipping (shock and vibration).

Additionally, the plating on the substrate 106 that interfaces with LEC assembly contact is different from other typical edge connectors for other circuits. The package/LEC interface is subject to significant system dynamic inputs and is critical to HSIO signal integrity performance. Therefore, the connector assemblies described herein prevent micro-motion/plating wear and fretting by actively retaining the connector with a retaining force (e.g., a force in the range of 3-9 lbf).

Figure 1B:
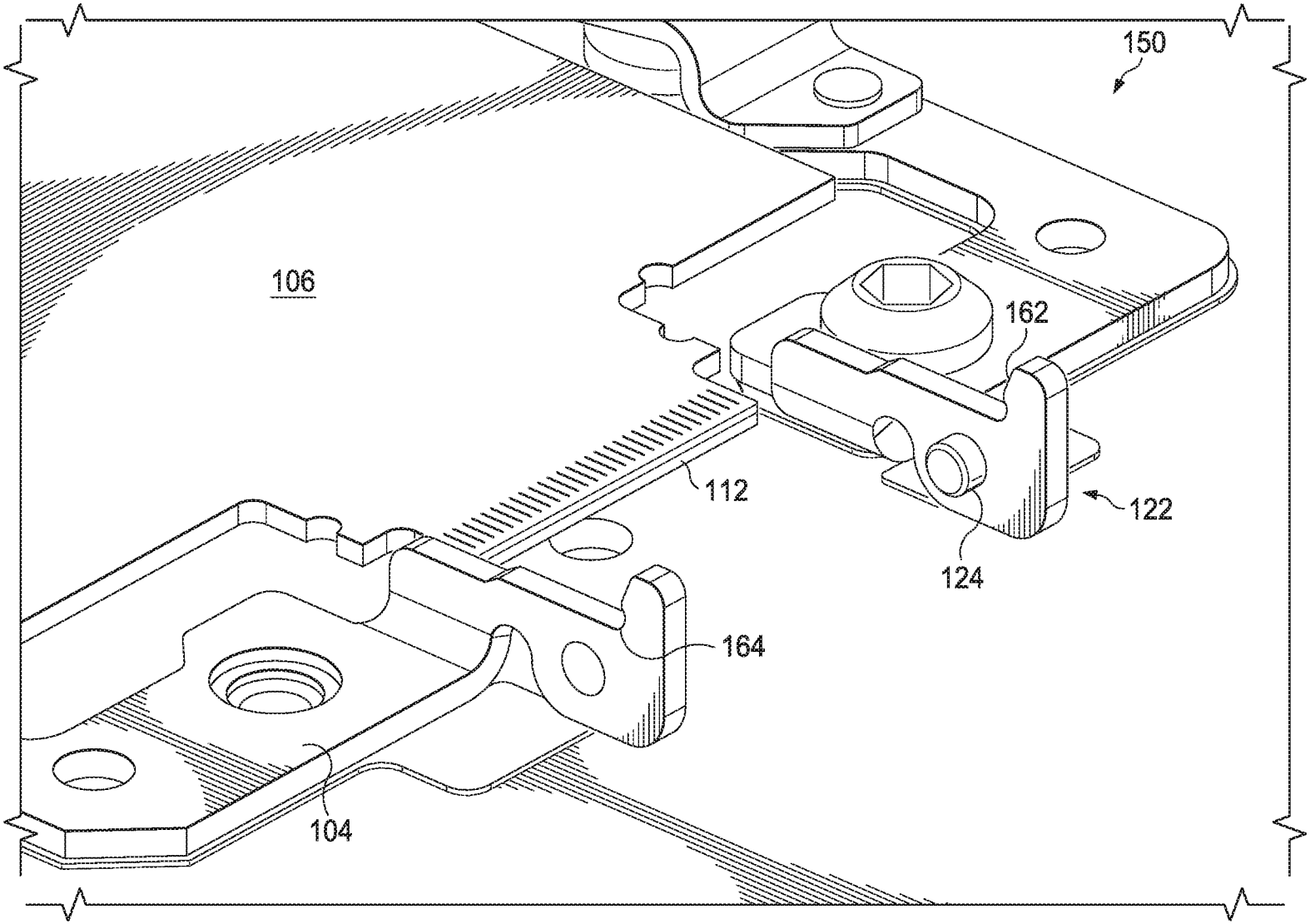
FIG. 1B is a schematic diagram of an example of a bolster plate protrusion for receiving a connector assembly in accordance with embodiments of the present disclosure.

FIG. 1B is a schematic diagram 150 of an example of a bolster plate protrusion 124 for receiving a connector assembly in accordance with embodiments of the present disclosure. As shown in FIG. 1B, a bolster plate protrusion 124 can include a pin or ball bearing or other spherical or substantially spherical element that can be received by a connector assembly (as described further in the sections below). The bolster plate protrusion 124 can be located on a bolster plate arm 122 on the bolster plate 104. Bolster plate arm 122 can be a protrusion or stamped/inserted elongation extending from the bolster plate 104. FIG. 1B also shows the substrate 106 and the substrate diving board 112. The substrate diving board 112 includes one or more electrical contacts that electrically connect substrate elements (such as a CPU) to external elements, through the LEC assembly.

In embodiments, the bolster plate arm can include an angled face 162. A spring receiving area 164 can be at the bottom of the angled face 162. The angled face 162 can facilitate a translational force as a spring arm is moved downwards along the angled face 162. The spring arm can lock into the spring receiving area 164, which can be a circular groove having dimensions to accommodate a spring arm.

Figure 1C:
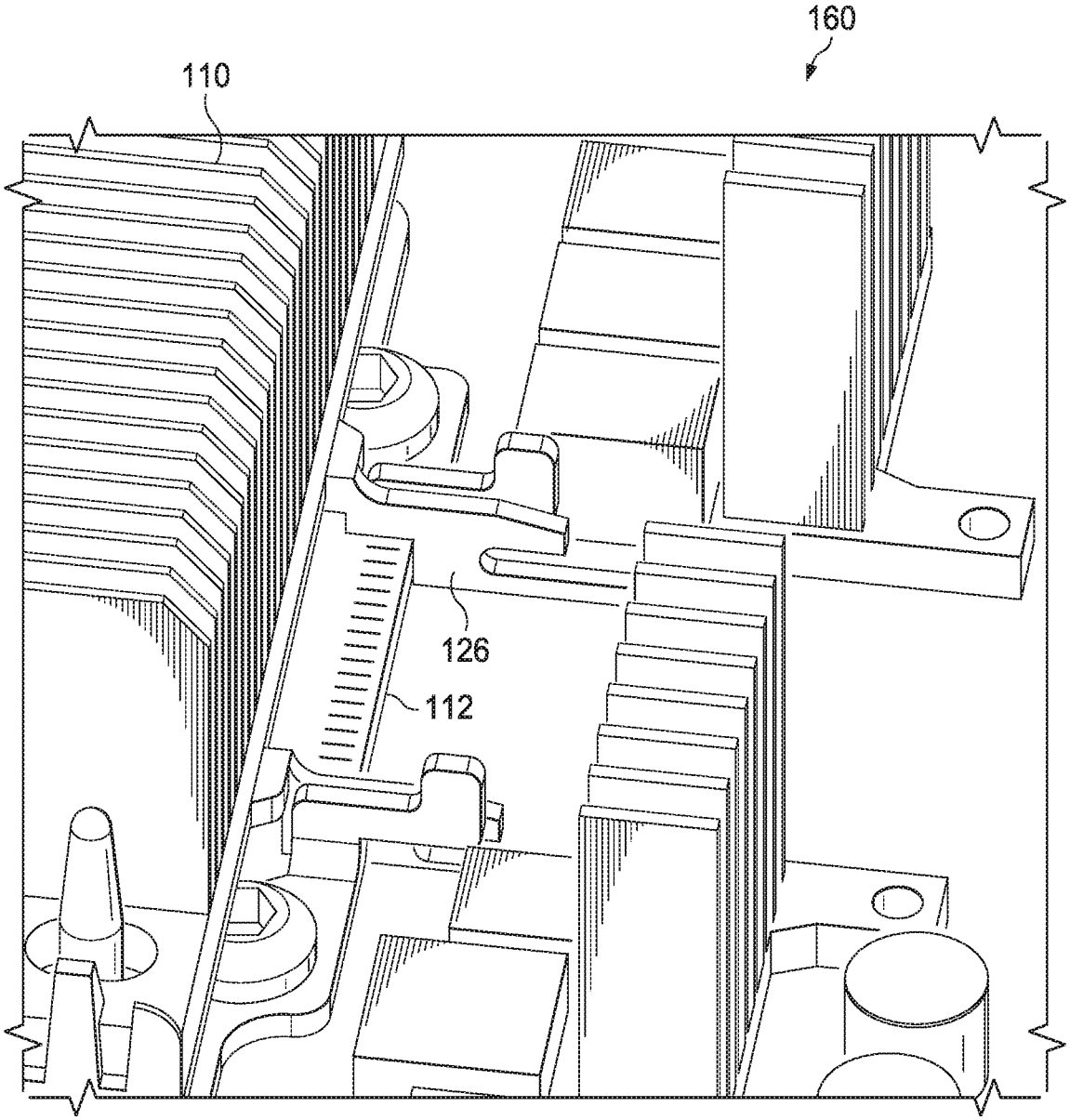
FIG. 1C is a schematic diagram of another example of a bolster plate protrusion for receiving a connector assembly in accordance with embodiments of the present disclosure.

FIG. 1C is a schematic diagram 160 of another example of a bolster plate protrusion 126 for receiving a connector assembly in accordance with embodiments of the present disclosure. The bolster plate protrusion 126 can be an elongated protrusion configured to be received by a connector assembly, such as that shown in FIG. 4A-4B.

Figure 1D:
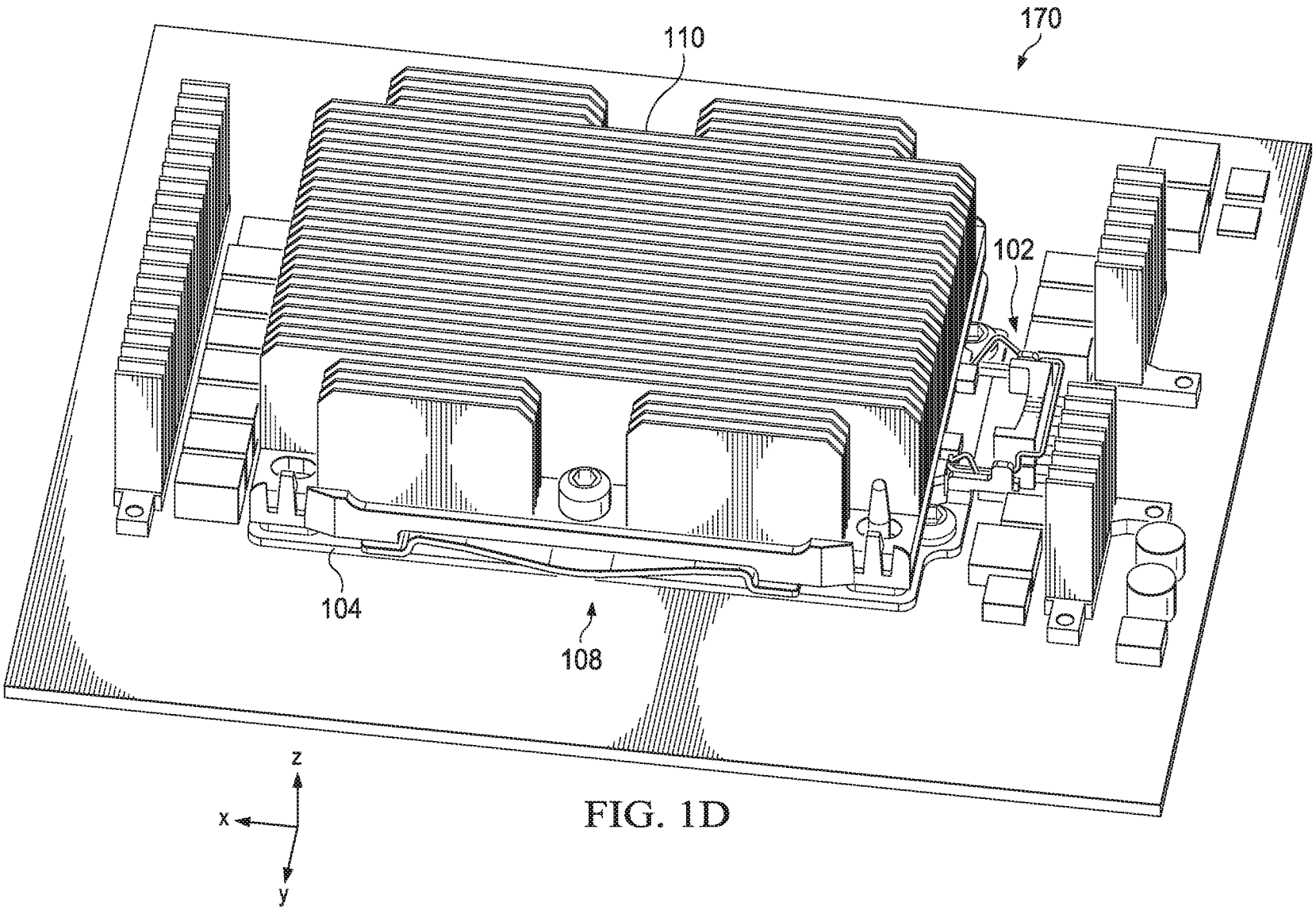
FIG. 1D is a schematic diagram of a central processing unit board that includes linear edge connector assembly in accordance with embodiments of the present disclosure.

FIG. 1D is a schematic diagram 170 of a system that includes a mother board 108 and linear edge connector (LEC) assembly 102 in accordance with embodiments of the present disclosure. The linear edge connector (LEC) assembly 102 shown in FIG. 1D can be any of the connector assembly embodiments described herein. Of note in FIG. 1D is the limited clearance available for connecting the linear edge connector assembly to the bolster plate and substrate diving board. The design space for LEC is strictly constrained by the system layout to clear other components on the board and in the chassis compared to typical edge connectors. The form factor of the LEC assembly 102 can accommodate the small spaces available on the mother board 108. For example, the form factor of the LEC connector assembly 102 can be on the order of 20 mm W (y-direction), 11 mm Height (z-direction), and 35 mm depth (x-direction).

Figure 2:
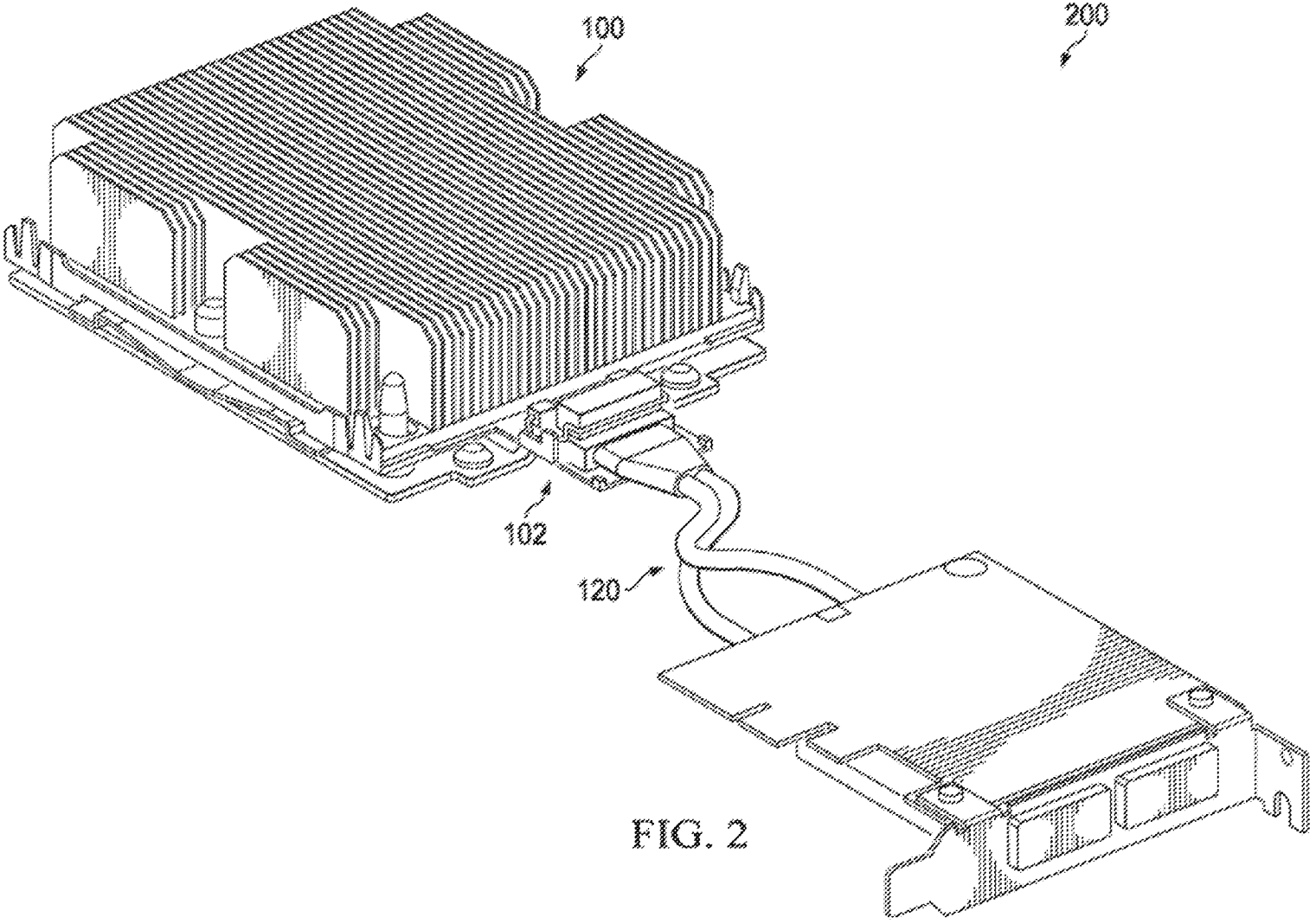
FIG. 2 is a schematic diagram of central processing unit board connected to another board by a cable assembly in accordance with embodiments of the present disclosure.

FIG. 2 is a schematic diagram of central processing unit board connected to another board by a cable assembly in accordance with embodiments of the present disclosure.

The aforementioned factors lay great challenges on LEC retention mechanism design to retain connector in place and prevent plating wear and fretting under use/shipping conditions. This disclosure describes embodiments for connector assemblies having the following general characteristics:

Each can lock the connector to a rigid component on the substrate;

Each can constrain translation/rotation in all directions; and

Each includes an active retention force between package diving board and the connector assembly.

In embodiments, the connector assembly uses a latch mechanism that provides active retention force along mating direction by pushing the connector against the substrate. This prevents relative movement between the connector contacts and substrate, and hold the connector in place in the system stack-up.

The following retention mechanism designs are proposed here to solve the aforementioned fretting issue. Embodiments of this disclosure can be characterized by including an active retention force. Among the embodiments of this disclosure are:

1. Torsional spring latch retention mechanism design
2. C shape channel-plastic enable latch retention mechanism design
3. Cam retention mechanism design
4. Hook latch retention mechanism Embodiment 1

Torsional Spring Latch Retention Mechanism

Figure 3A:
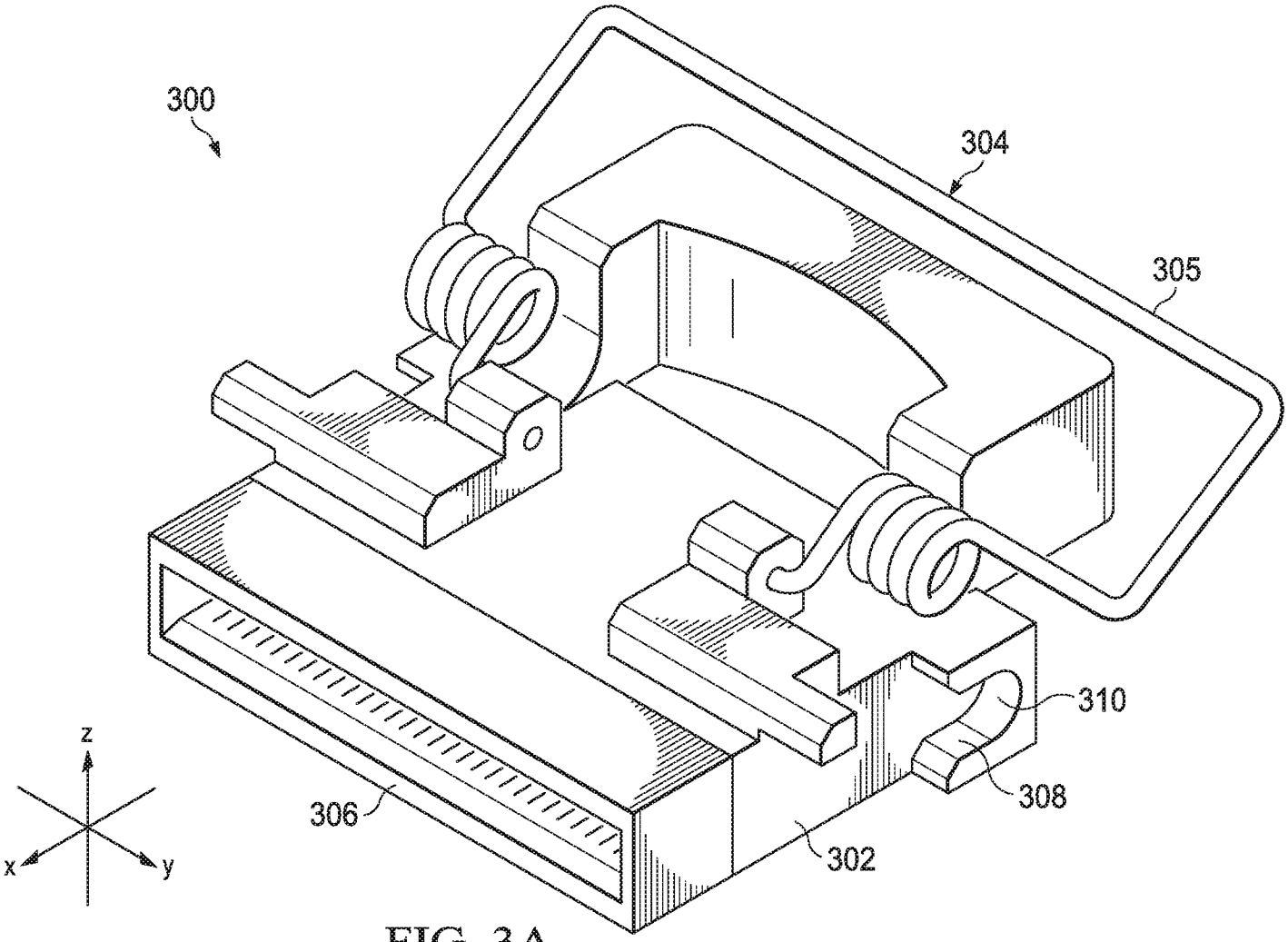
FIG. 3A is a perspective view of a schematic diagram of a connector assembly in accordance with embodiments of the present disclosure.

FIG. 3A is a perspective view of a schematic diagram of a connector assembly 300 in accordance with embodiments of the present disclosure. The connector assembly 300 includes a connector body 302. Connector body 302 is configured to support a spring 304 to rotate about the y axis. The spring 304 can act as a spring latch by connecting to a receiving portion of the bolster plate. The spring 304 can include pins that fit into pin holes on the connector body 302. The spring 304 can be configured with a predetermined spring constant to provide a desired force. The spring 304 can also be configured to have a spring handle 305 that can includes a cross-sectional diameter to fit into a receiving area 364 in a receiving element 316 of a bolster plate, shown in FIG. 3B. The bolster plate arm 316 also includes an angled face 362. The spring handle 305 can contact the angled face 362 as the handle is rotated downward. Spring handle 305 pushes on the bolster plate arm 316, which pushes the LEC assembly 300 towards the diving board 326. The spring 304 compresses as the handle is moved downwards against the face 362 of bolster plate arm 316. The spring handle 305 can lock into place in the curved receiving area 364.

By using a coiling element in the spring latch design, the spring rate and deflection range of the torsional spring can be controlled so that it is not sensitive to deflection range (which is driven by system stack tolerance) and can provide higher retention force in the desired load range. The spring 304 can have a low spring rate so that the spring 304 is not sensitive to deflection range. The spring 304 can be configured to provide 3-9 lbf of force range can facilitate a balance between the retention force and ergonomic force. Another advantage of introducing coiling element is the relatively small permanent set (plastic deformation). Adding coil element means adding more material and lowering the spring rate. As a result, the spring can mainly operate in elastic range (deformation is reversible) and reduce material yielding in plastic range and further less load loss (deformation is permanent and not reversible; therefore the plastic deformation is called permanent set).

The connector assembly 300 can include an electrical interface 306. Electrical interface 306 can receive the substrate diving board 326 and electrically connect the substrate elements with external elements through electrical contacts on the diving board 326 and the electrical interface 306 of the LEC assembly 300. The LEC assembly 300 can include a cable assembly 312 (shown in FIG. 3B). The electrical interface 306 can electrically connect the contacts on the diving board 326 to the conductors of the cable assembly 312. The cable assembly can connect to other computing and/or network elements through IFP plugs on the other end of the IFP cable. See FIG. 2 for further details.

The connector assembly 300 can include a connector body that includes a bolster plate extrusion receiver, such as a cutout 308 to receive a protrusion on the bolster plate. The protrusion can be a pin-shaped protrusion, ball bearing, or other shape to connect to the connector body 302. The connector body 302 can also include a backwall hardstop 310 to limit the range of travel of the connector assembly in the x-direction (i.e., towards the bolster plate). The cutout 308 can also include a top wall and bottom wall to limit motion of the connector in the z-direction. The bolster plate protrusion can also engage the connector body 302 in the cutout 308 on both sides of the connector body to limit motion in the y-direction.

Figure 3B:
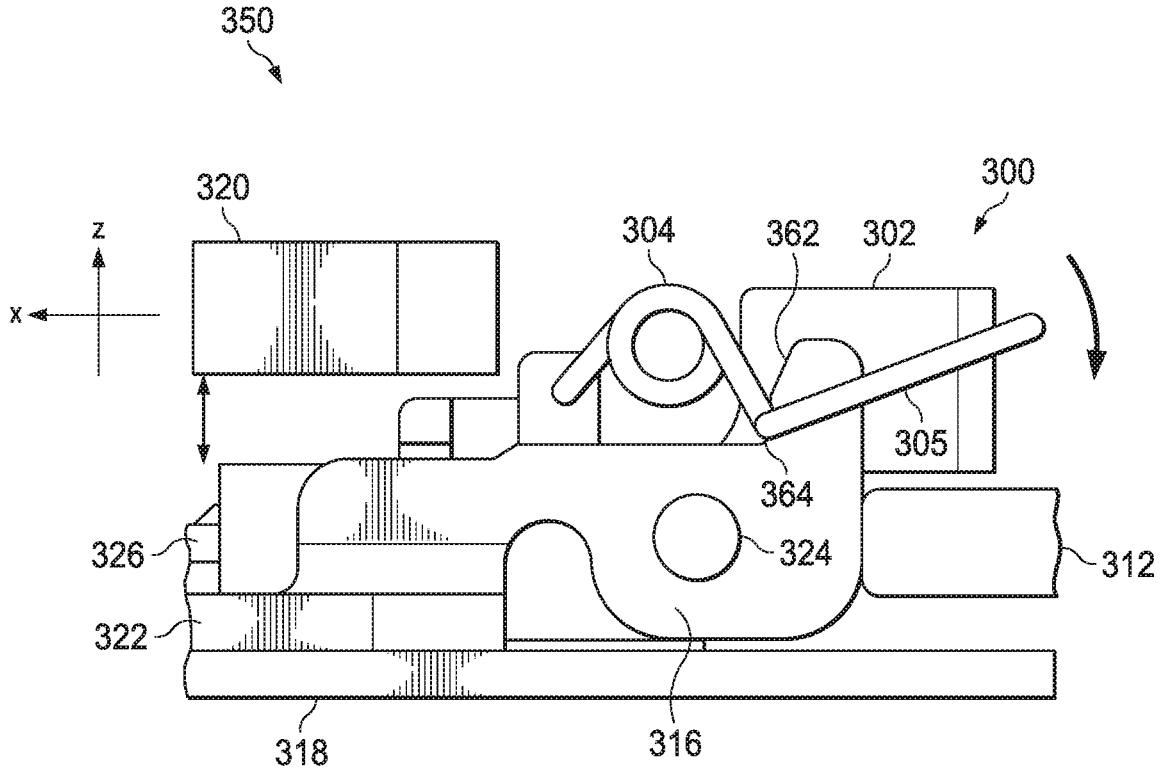
FIG. 3B is a side view of a schematic diagram of a connector assembly that is connected to a linear edge connector in accordance with embodiments of the present disclosure.

FIG. 3B is a side view of a schematic diagram 350 of a connector assembly 300 that is connected substrate diving board 326 in accordance with embodiments of the present disclosure. The side view shows the spring 304 in contact with a connector assembly receiving portion 316 of the bolster plate 322. The connector assembly receiving portion 316 includes an angled face. When the spring handle 305 contacts the angled face, the spring handle 305 can slide downwards and in the x-direction (towards the bolster plate), pushing the connector assembly onto the substrate diving board 326, and thereby electrically connecting the substrate diving board 326 to one or more cables 312. The spring coils can also compress as the spring handle 305 moves downwards on the angled face. The angled face can include a recess at the bottom, into which the spring handle 305 can slide into and lock into place.

The connector assembly receiving portion 316 of bolster plate 322 can include a protrusion 324, such as a pin (such as that shown in FIG. 2). The protrusion 324 can interface with a recess or cutout on the connector body, as described above.

Also shown in FIG. 3B is an example PHLM element 320 that is connected to the substrate 318 and that overhangs over the connector assembly receiving portion 316 of bolster plate 322. The heat sink 320 is shown to provide a representation of the small clearances involved in attaching the connector assembly 300 to the edge connector 326. An example of a PHLM element 320 can include a heat sink.

Advantages

The advantages of the torsional spring latch are readily apparent to those of skill in the art. Among the various advantage are:

a. By using coiling element in the spring latch design, the spring rate and deflection range of the torsional spring can be controlled so that it is not sensitive to deflection range and can provide higher retention force in the desired load range. Low spring rate so that the spring is not sensitive to deflection range. Load range can be well controlled in the desired window compared to current design.

b. Coil elements can introduce more material to the spring design in small space so that the spring has relatively small permanent deformation and further less load loss.

c. Using the same or even less space without major change on connector and other components in the system assembly, the torsional spring can achieve the advantages in the above mentioned two bulletins.

Embodiment 2

C Shape Channel-Plastic Enable Latch Retention Mechanism

Figure 4A:
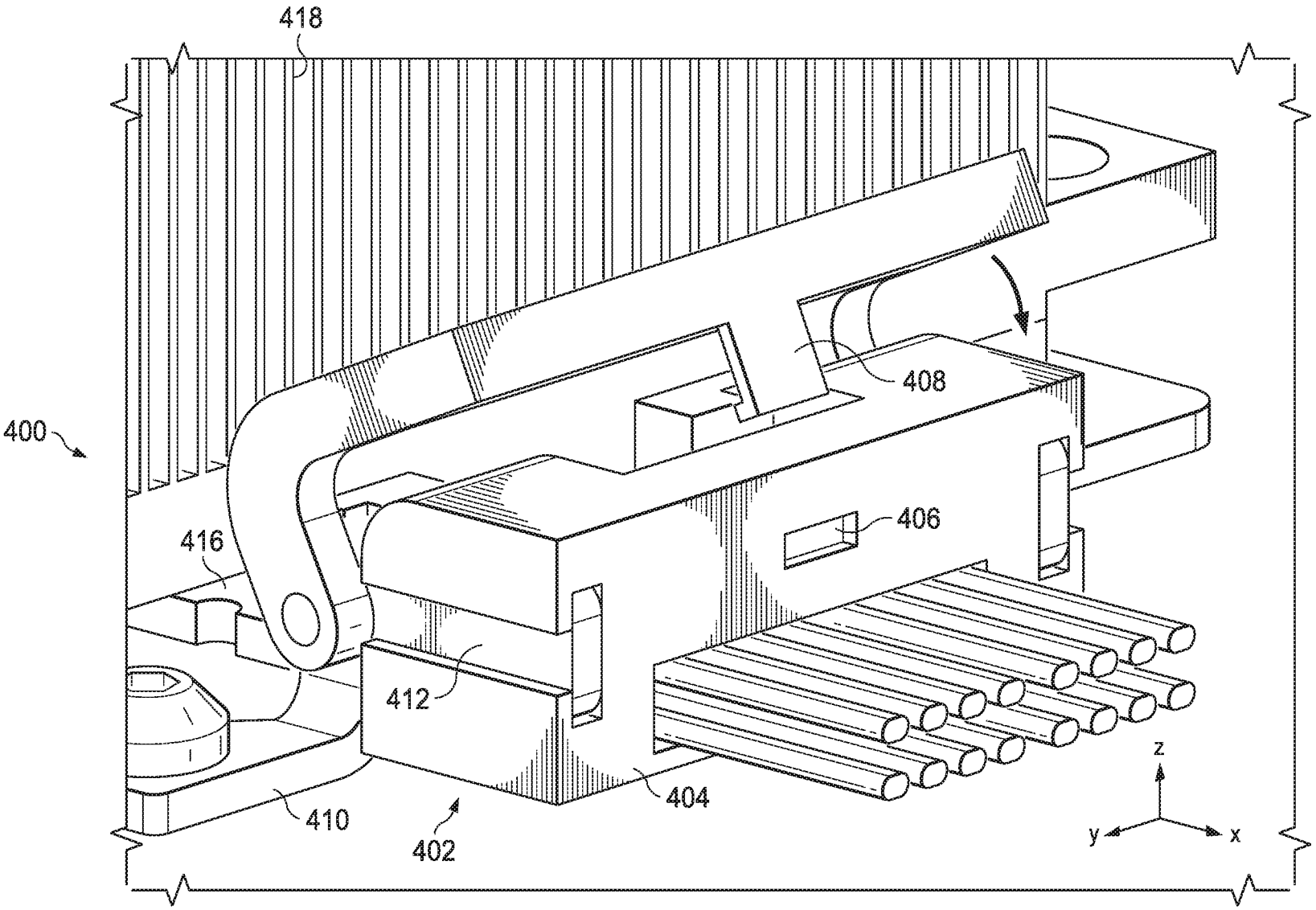
FIG. 4A is a perspective view of a schematic diagram of a connector assembly that is connected to a linear edge connector and bolster plate in accordance with embodiments of the present disclosure.

FIG. 4A is a perspective view of a schematic diagram 400 of a connector assembly 402 that is connected to a substrate diving board 416 and bolster plate 410 in accordance with embodiments of the present disclosure. The connector assembly 402 can include a similar design as shown in FIG. 3 for connector assembly 300. Connector assembly 402, however, does not include a torsional spring. Connector assembly 402 includes a notch 406 on a back side of the connector body 404 for receiving a lever latch 408. Lever latch 408 is connected to the bolster plate 410 by, for example, a pin, and is configured to rotate about the pin. The lever latch 408 can snap into place into the notch 406 to hold the connector assembly 402 in place. In some embodiments, the lever latch 408 can also apply a retention force in the x-direction (negative x direction in FIG. 4A).

Figure 4B:
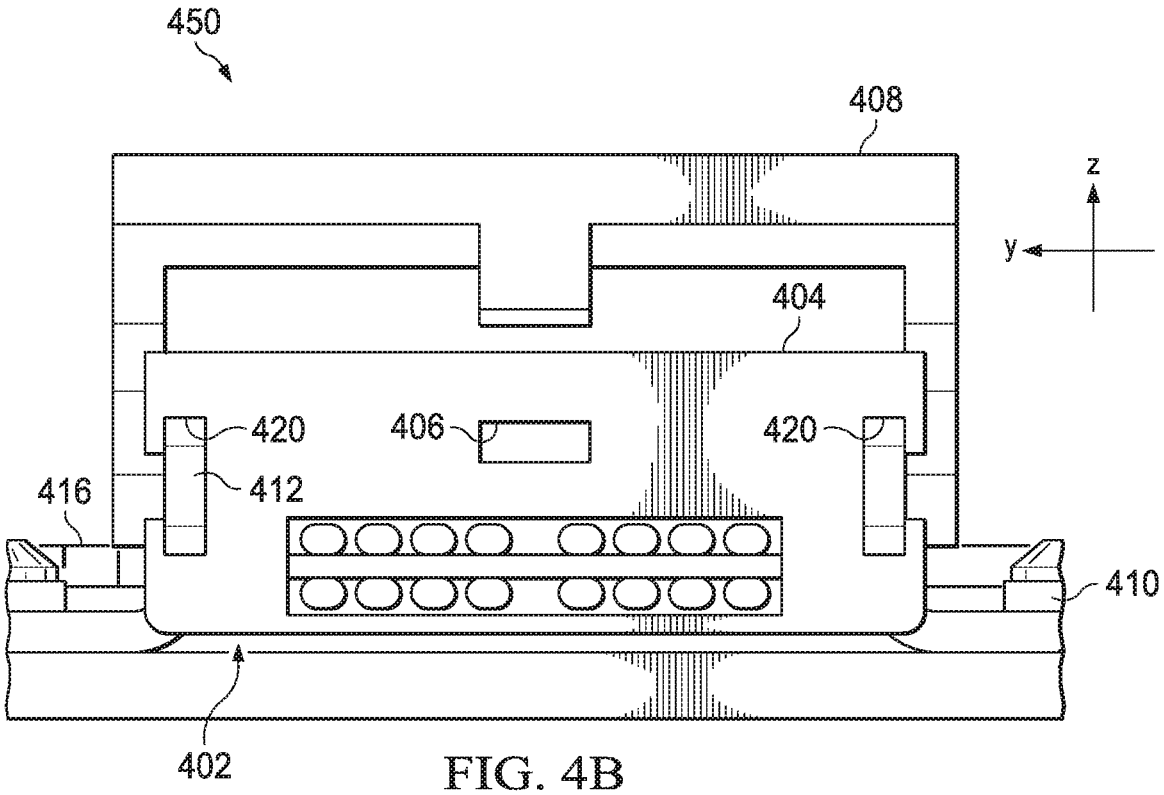
FIG. 4B is a schematic diagram of a connector assembly that is connected to a linear edge connector in accordance with embodiments of the present disclosure.

The bolster plate 410 can include a bolster plate protrusions 412. The connector assembly 402 can include c-shaped channels to receive the protrusions 412, as shown in FIG. 4B. FIG. 4B is a schematic diagram 450 of a connector assembly 402 that is connected to a linear edge connector 416 in accordance with embodiments of the present disclosure. The connector assembly 402 includes a connector body 404. The connector body 404 can include a c-shaped channel 420. The c-shape channel 420 can be on on two sides of the connector body 420. The c-shaped channels can receive a bolster plate protrusion 412. The bolster plate protrusion 412 can include a rod-shaped feature extending from the bolster plate. The c-shaped channel 412 can constrain connector movement for almost all directions of translation and rotation except for translation along cable direction (x-direction).

The latch 408 on bolster plate 410 can provide relatively high retention force along cable direction (x-direction) and push the connector assembly 402 against the bolster plate 410 and the substrate diving board 416. Specifically, the plastic enable latch 408 is part of the bolster plate 410. The latch 408 can be locked into the notch cavity 406 on back of the connector body 404 to push the connector assembly 402 against the substrate diving board 416. The corresponding retention force will control the movement in x-direction. Therefore, the latch retention mechanism design can enforce good translation/rotation constrains in all directions and the connector can be well retained in the assembly during shock/vibration conditions.

Advantages

Advantages of this embodiment are readily apparent to those of skill in the art. Among the advantages are:

a. Motion constrains in all directions of translation and rotation.

b. High yield in manufacturing due to low tolerance requirements for the latch and the c-shaped channels and the bolster plate extrusions.

Embodiment 3

Cam Retention Mechanism Design

Figure 5A:
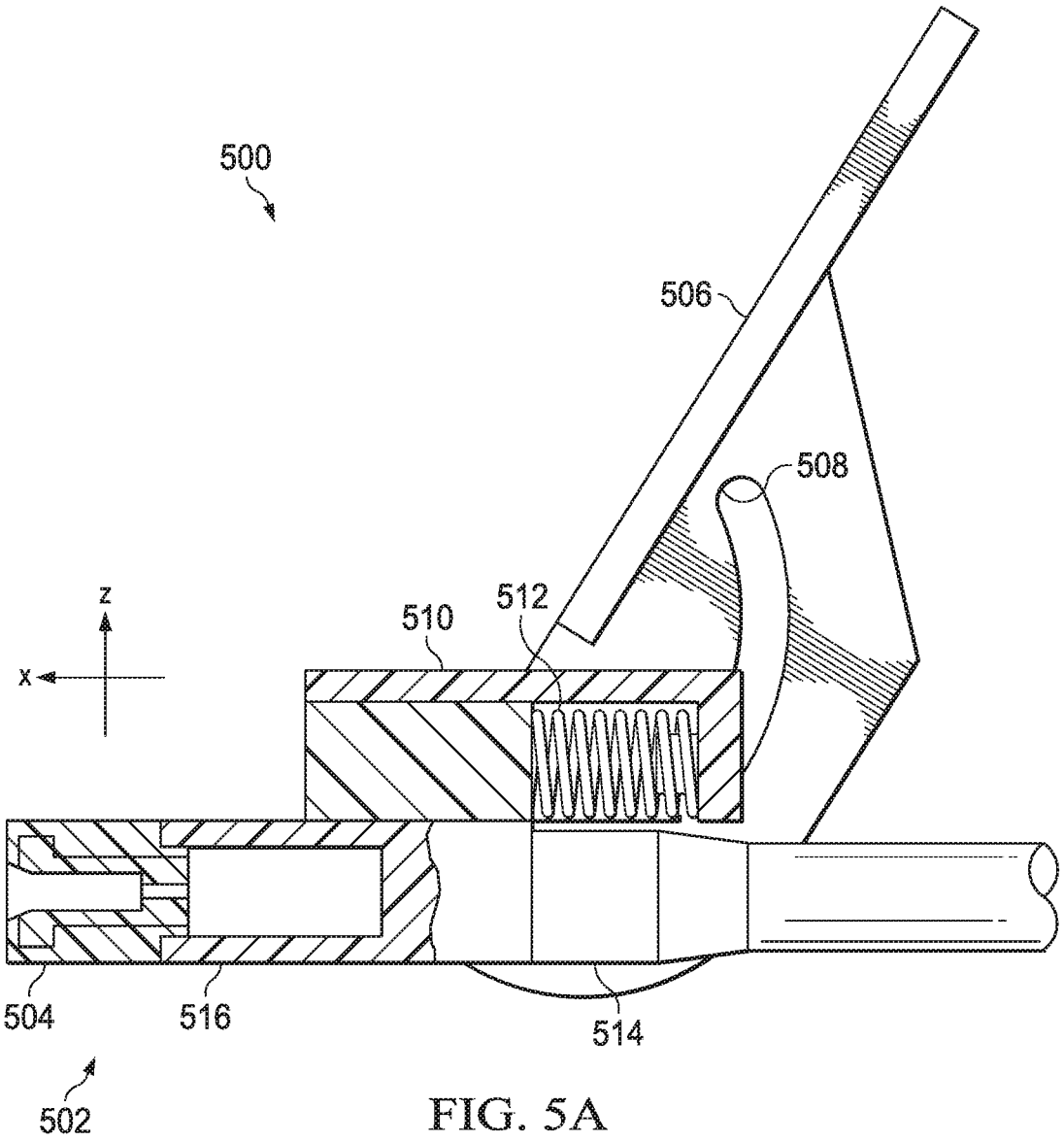
FIG. 5A is a schematic diagram of a connector assembly in accordance with embodiments of the present disclosure.

FIG. 5A is a schematic diagram 500 of a connector assembly 502 in accordance with embodiments of the present disclosure. For a bolster plate that includes a pin-style protrusion, such as that described in FIG. 2, a connector assembly 502 can include a lever 506 that includes a cam slot 508 on two sides of connector body 516. The cam slot 508 is designed to receive a bolster plate pin as the lever is pushed downwards, which also causes the connector assembly 502 to slide toward substrate diving board (522 in FIG. 5C).

The connector assembly 502 can include a slider 510 that can house one or more springs 512. The connector assembly also includes an electrical interface 504 that can receive substrate diving board and electrically connect contacts on the edge connector to one two cable bundles in the cable assembly 514.

Figure 5B:
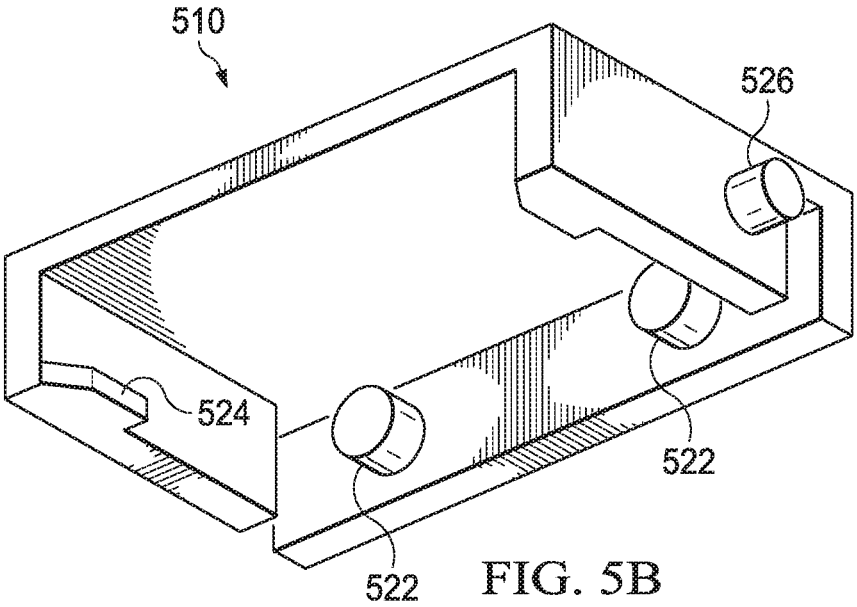
FIG. 5B is a schematic diagram of a slider for an embodiment of a connector assembly in accordance with embodiments of the present disclosure.

FIG. 5B is a schematic diagram of a slider 510 for an embodiment of a connector assembly 502 in accordance with embodiments of the present disclosure. The connector assembly includes three components: a slider 510, a connector body 502, and lever 506 with cam slot 508. FIG. 5B shows a perspective view of slider 510 as well as the underside of slider 510. The slider 510 can accommodate two compressive springs at reference pins 522. Two reference pins 522 are located inside the slider at the back end for the compressive spring stabilization under loaded state.

The slider 510 also includes cam pins that serve as a connection point or anchor feature for the lever 506 (i.e., the lever 506 is connected to the slider 510 at reference pins 526 and the lever 506 is able to rotate about the slider about the reference pins 526).

Figure 5C:
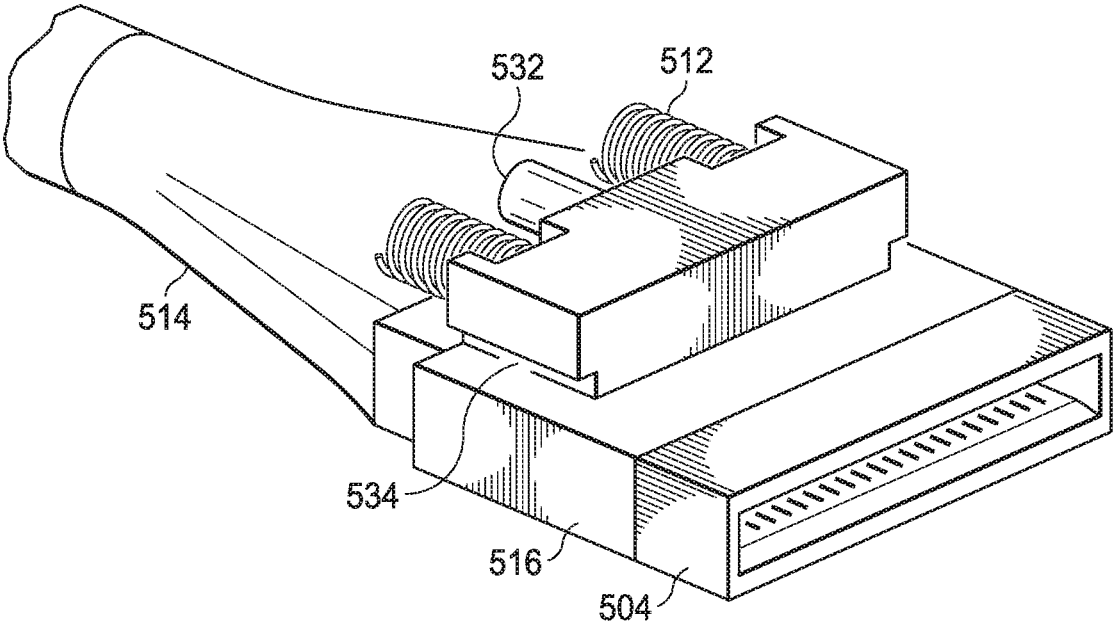
FIG. 5C is a schematic diagram of a connector body for an embodiment of a connector assembly in accordance with embodiments of the present disclosure.

The slider 510 can also include a guide 524 that fits into a slot on the connector body 516, shown in FIG. 5C.

FIG. 5C is a schematic diagram of a connector body 516 for an embodiment of a connector assembly 502 in accordance with embodiments of the present disclosure. The connector body 516 can include an electrical interface 504 that can receive the edge connector and electrically connect the contacts on the substrate diving board 522 to conducts in the cable assembly 514 attached to the connector assembly 502. The connector body 516 can also support one or more compressive springs 512. The compressive springs 512 can be located on the connector body 516 and preloaded when the slider 510 is being slide onto the connector body 516. The connector body also includes a slider slot 534 that can receive the guide 524 on the slider 510.

Figure 5D:
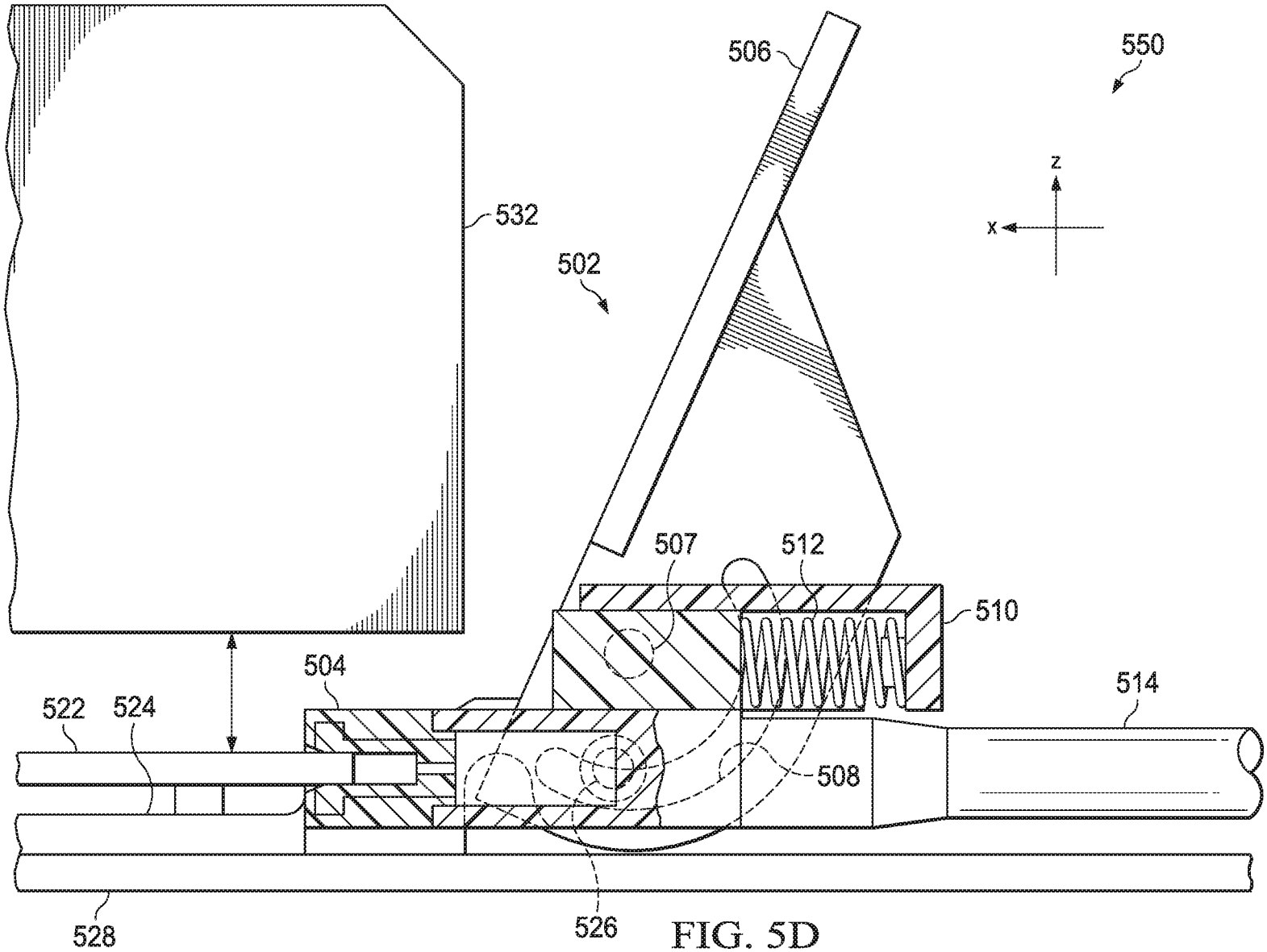
FIG. 5D is a schematic diagram of a connector assembly that is connected to a linear edge connector in accordance with embodiments of the present disclosure.

FIG. 5D is a schematic diagram 550 of a connector assembly 502 that is connected to a substrate diving board 522 in accordance with embodiments of the present disclosure. FIG. 5D shows the mother board 528 that holds the bolster plate 524 and substrate 522. The substrate 522 can be installed onto mother board 528 through PHLM (Package Heatsink Loading Mechanism) element 532. The PHLM element (e.g., heat sink) 532 is shown to provide relative perspective for the clearance between heat sink and the edge connector assembly 502 and/or bolster plate 524.

The two cam slot features 508 are located on two sides of the lever 506. The cam slots 508 can receive a bolster plate protrusion 526. Bolster plate protrusion 526 can include a pin or nub, similar to that shown in FIG. 2. The cam slots 508 can receive the bolster plate protrusion, which can rotate the lever 506 and transform the rotation into linear translation along the mating direction (x-direction).

The connector body 516 can include an electrical interface 504 for receiving the substrate diving board 522. Substrate diving board 522 can be received by the electrical interface 504. The electrical interface 504 can include an inner backwall (552 in FIG. 6D) that serves as a hardstop for the substrate diving board 522.

As the stop feature (back wall) of the connector housing cavity reaches substrate diving board 522, the compressive springs 512 inside the slider 510 start to be further compressed and push the connector assembly 502 against the substrate diving board 522. When the pin features 526 are locked at the end the cam slots 508, the compressive springs 512 can provide retention force 4 lbf+/−1 lbf along cable direction (x-direction). The compressive springs 512 can be selected to provide the predetermined retention force.

Figure 6A:
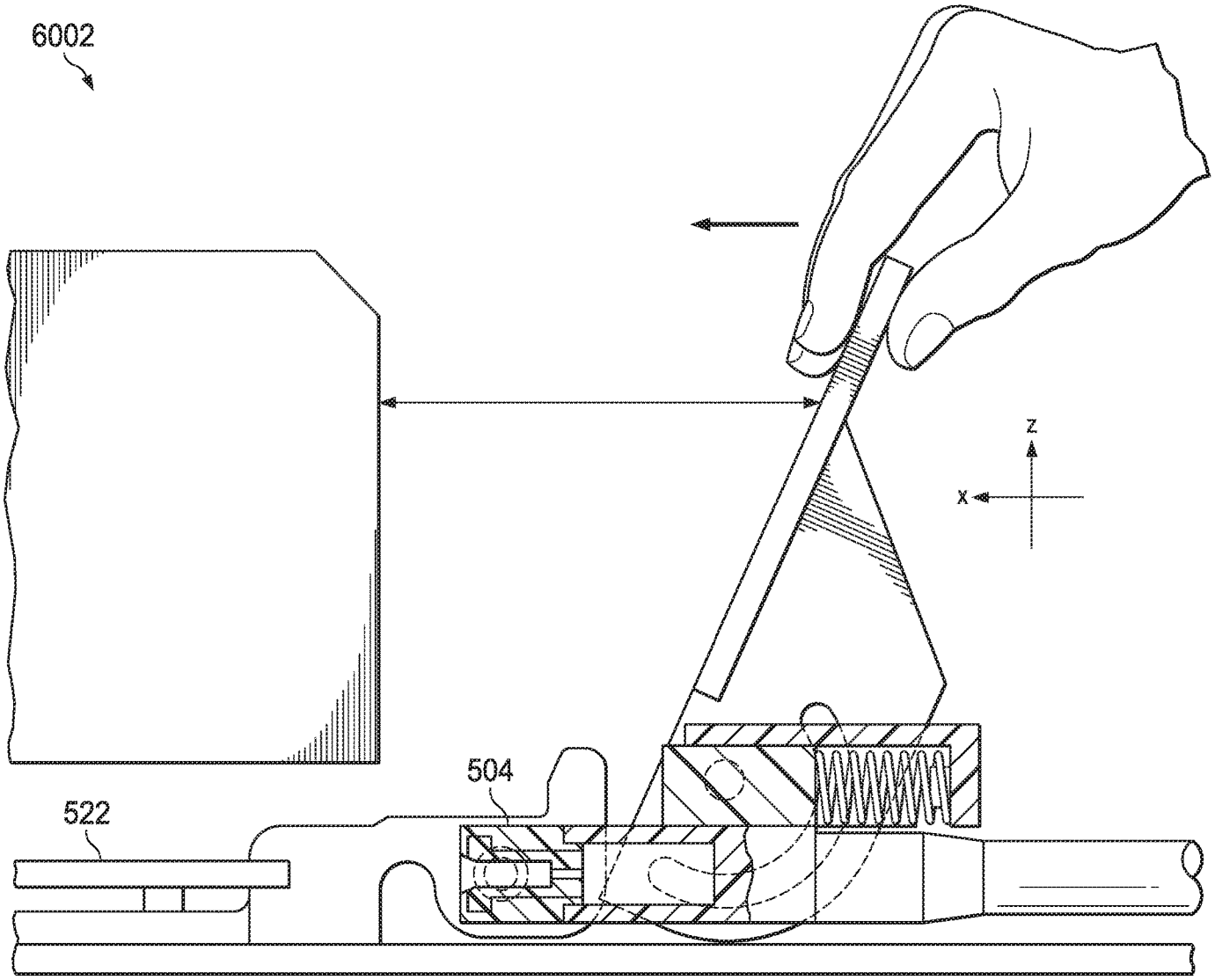
FIGS. 6A-6F are process flow diagrams for connecting the connector assembly of FIGS. 5A-5D to a linear edge connector and bolster plate in accordance with embodiments of the present disclosure.

FIGS. 6A-6F are process flow diagrams for connecting the connector assembly 502 of FIGS. 5A-5D to substrate diving board 522 and bolster plate 524 in accordance with embodiments of the present disclosure. In FIG. 6A, a user can drop the connector assembly onto a board surface (6002). The lever 506 can be used as a handle to manipulate the connector assembly 502. The lever 506 can be used to push the connector assembly 502 into position and bind with bolster plate protrusion (pin) 526 of the bolster plate 524. The lever 506 is offset from the electrical interface 504 of the connector assembly 502 to provide space for the lever 506 to be grasped and moved by a user.

In FIG. 6A, the lever 506, which is connected to the slider 510, is shown to have been pushed towards the substrate diving board and bind with bolster plate protrusion (pin) 526 of the bolster plate. In this position, the lever 506 is pushed towards bolster plate 524, and the slider 510 moves and compresses springs 512.

Figure 6B:
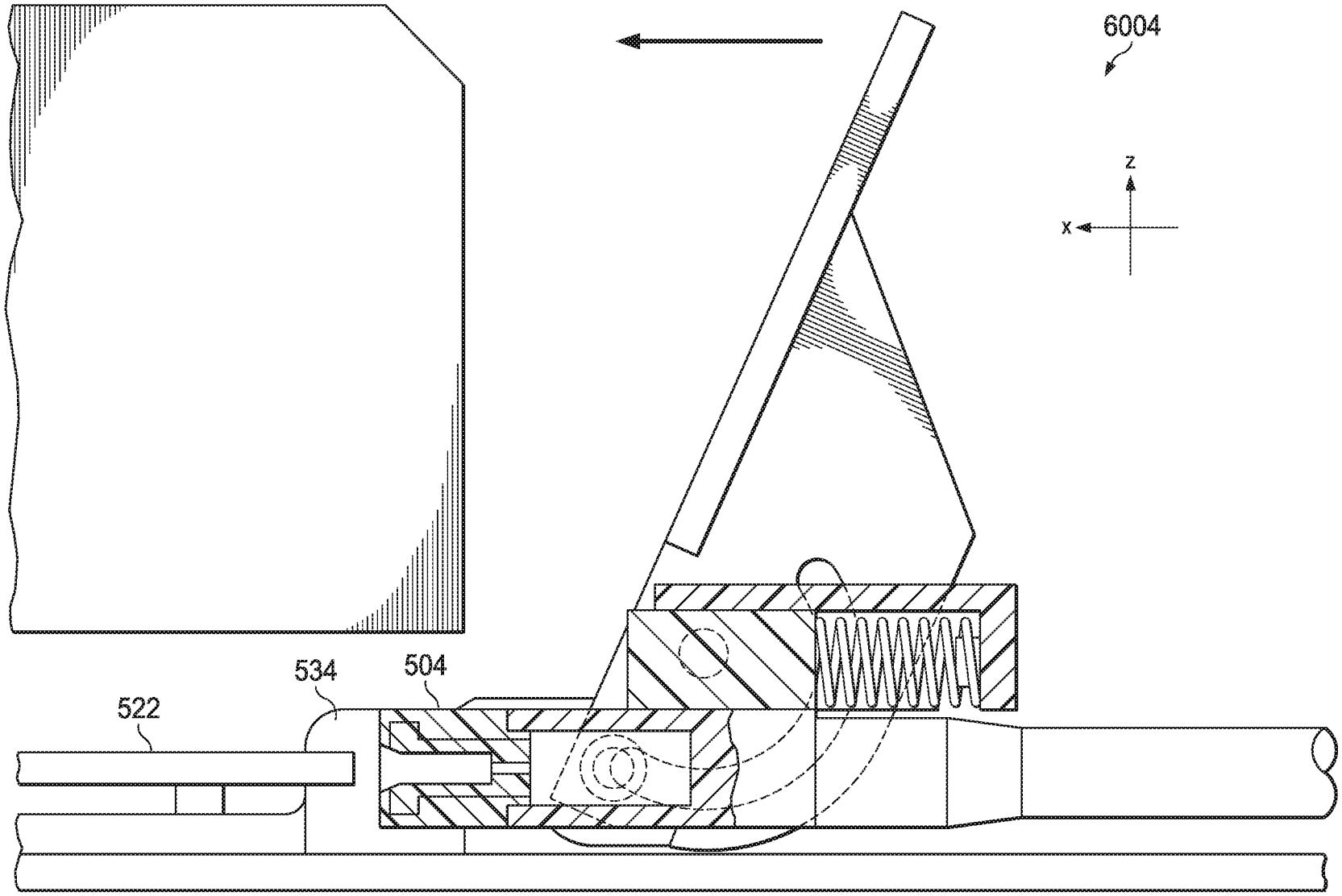
Figure 6C:
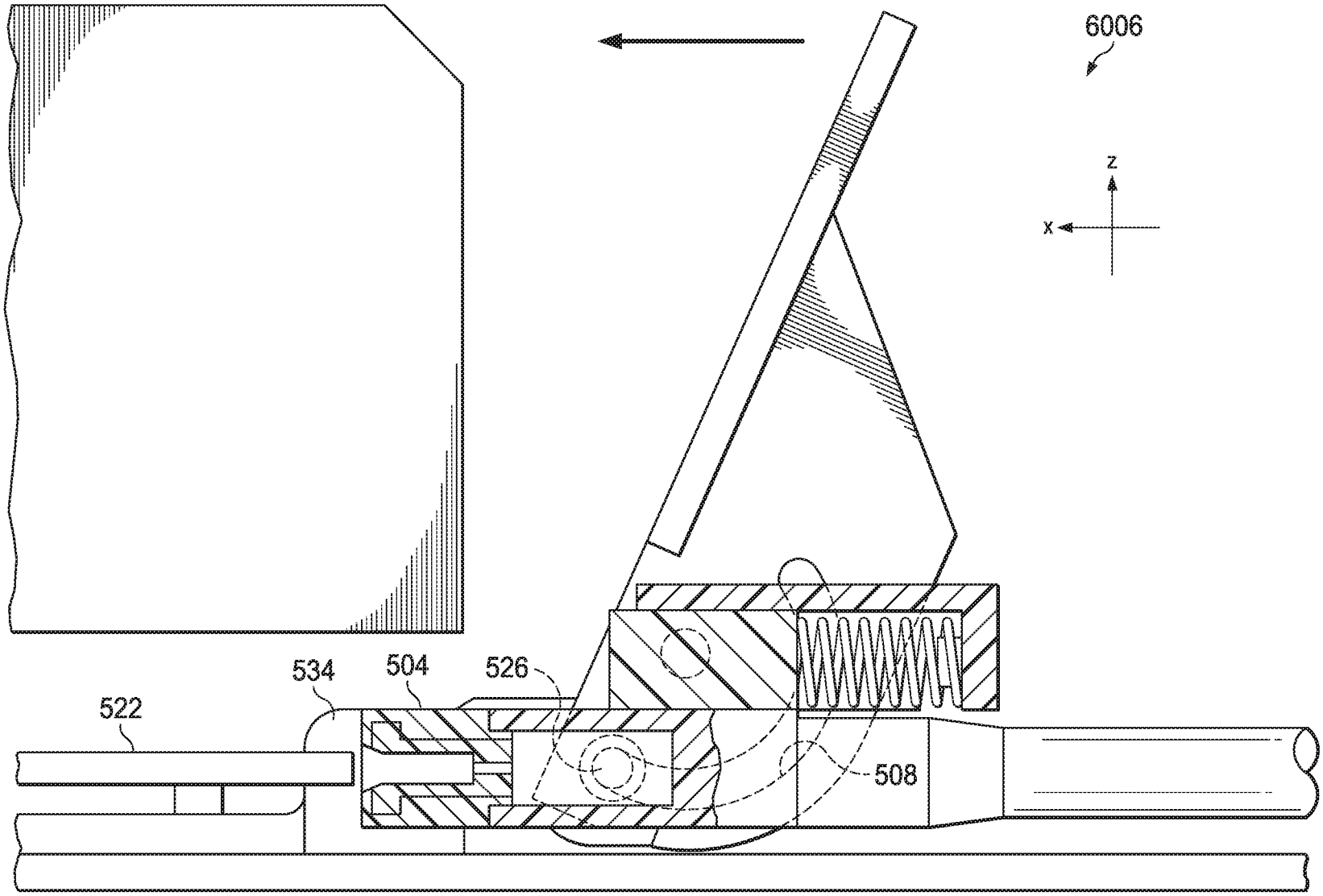

In FIG. 6B, the connector assembly 502 is pushed further towards the substrate diving board 522 (6004). In FIG. 6C, as the connector assembly 502 begins to engage the substrate diving board 522, the bolster plate protrusions 526 begins to enter the cam slots 508 (6006). As the connector being push against the substrate, the springs inside the slider/back-shell will be compressed and provide well controlled high retention force along cable direction when the cam mechanism is at lock position.

Figure 6D:
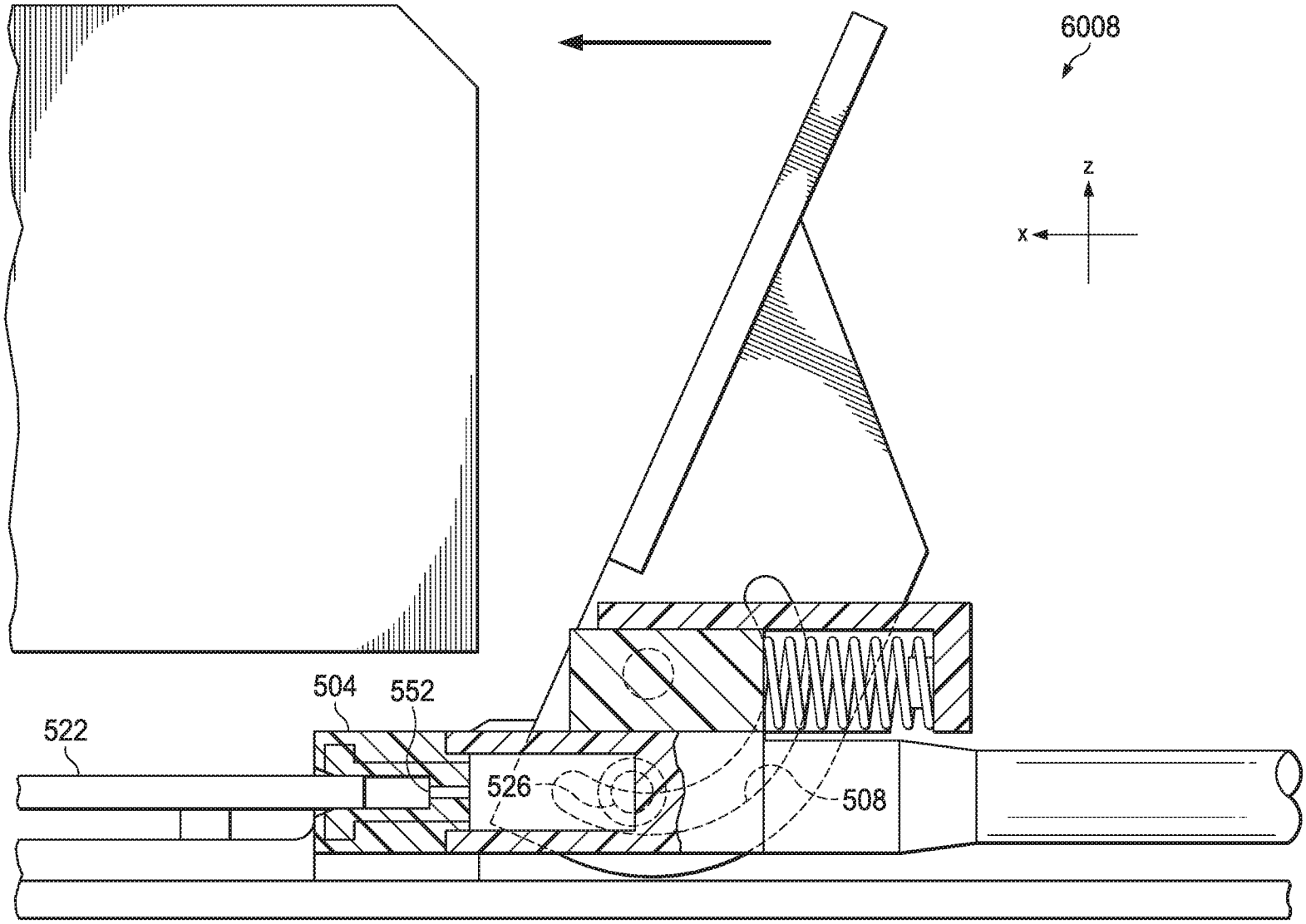
Figure 6E:
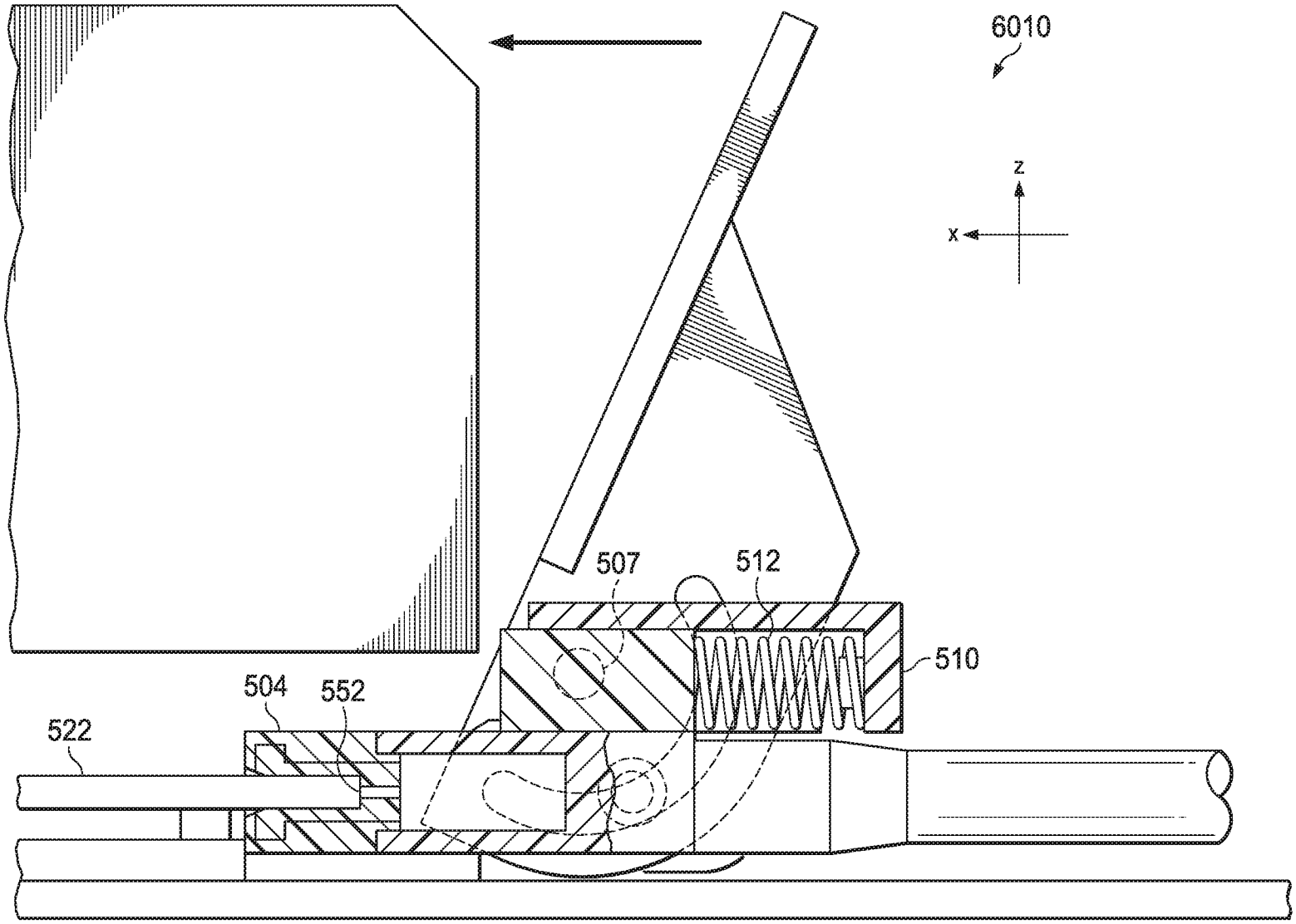

In FIG. 6D, the cam slot 508 engages the bolster pin protrusion 526 (6008). In FIG. 6E, the edge connector 522 is engaged by the electrical interface 504 until the edge connector 522 reaches the backwall 552 (6010). The lever 506 can be pushed downwards (z-direction) rotating about the pin 507. The preloaded spring in the slider will start to being further compressed when the connector back wall reaches the substrate edge.

Figure 6F:
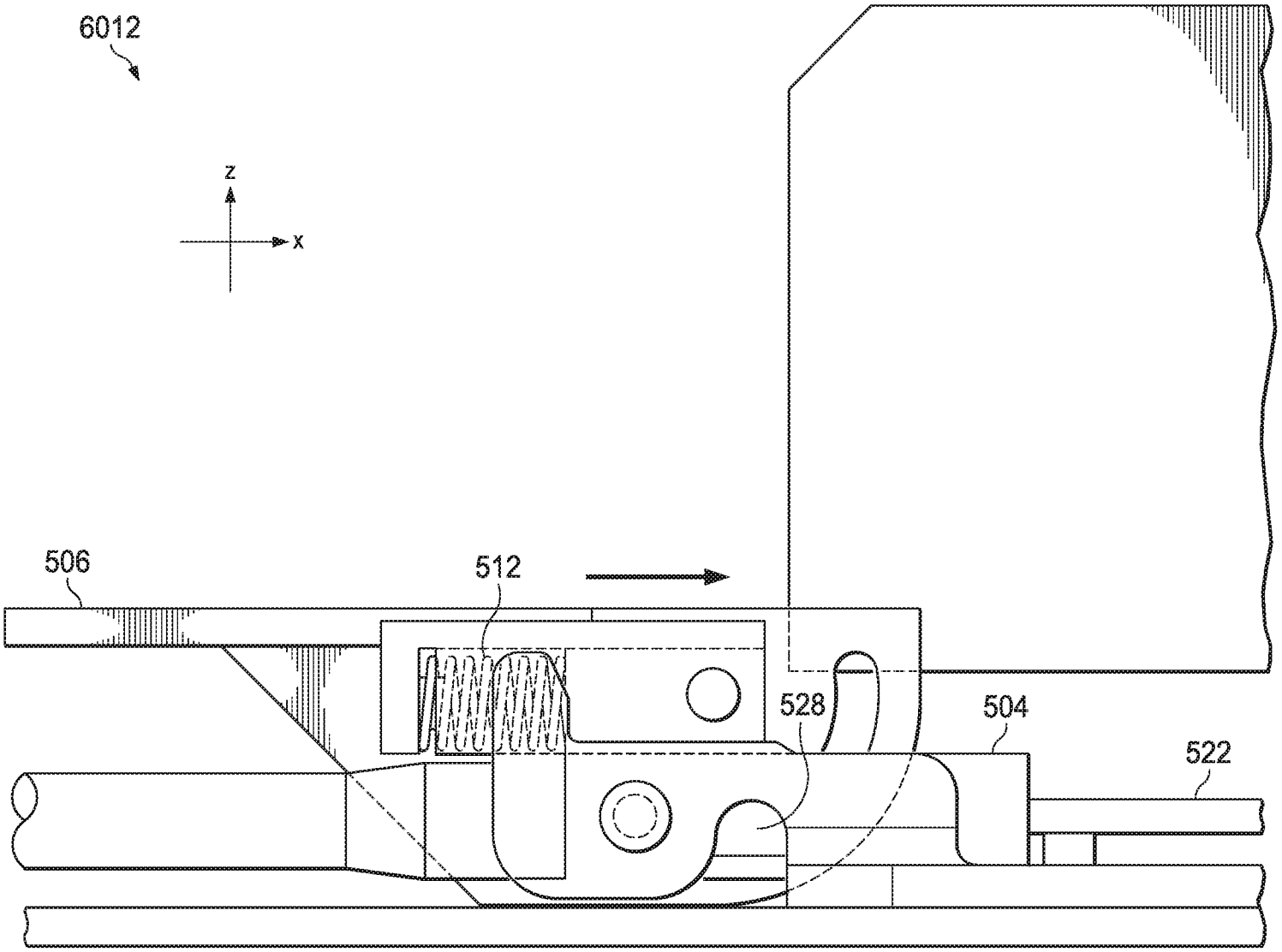

In FIG. 6F, the lever 506 can be pushed to rotate the cam to the final lock position, which forces slider (and connector) to move forward and further compress the springs inside the slider to load the connector onto the package substrate diving board and lock the connector in that position (6012).

Embodiment 4

Hook Latch Retention Mechanism

Figure 7A:
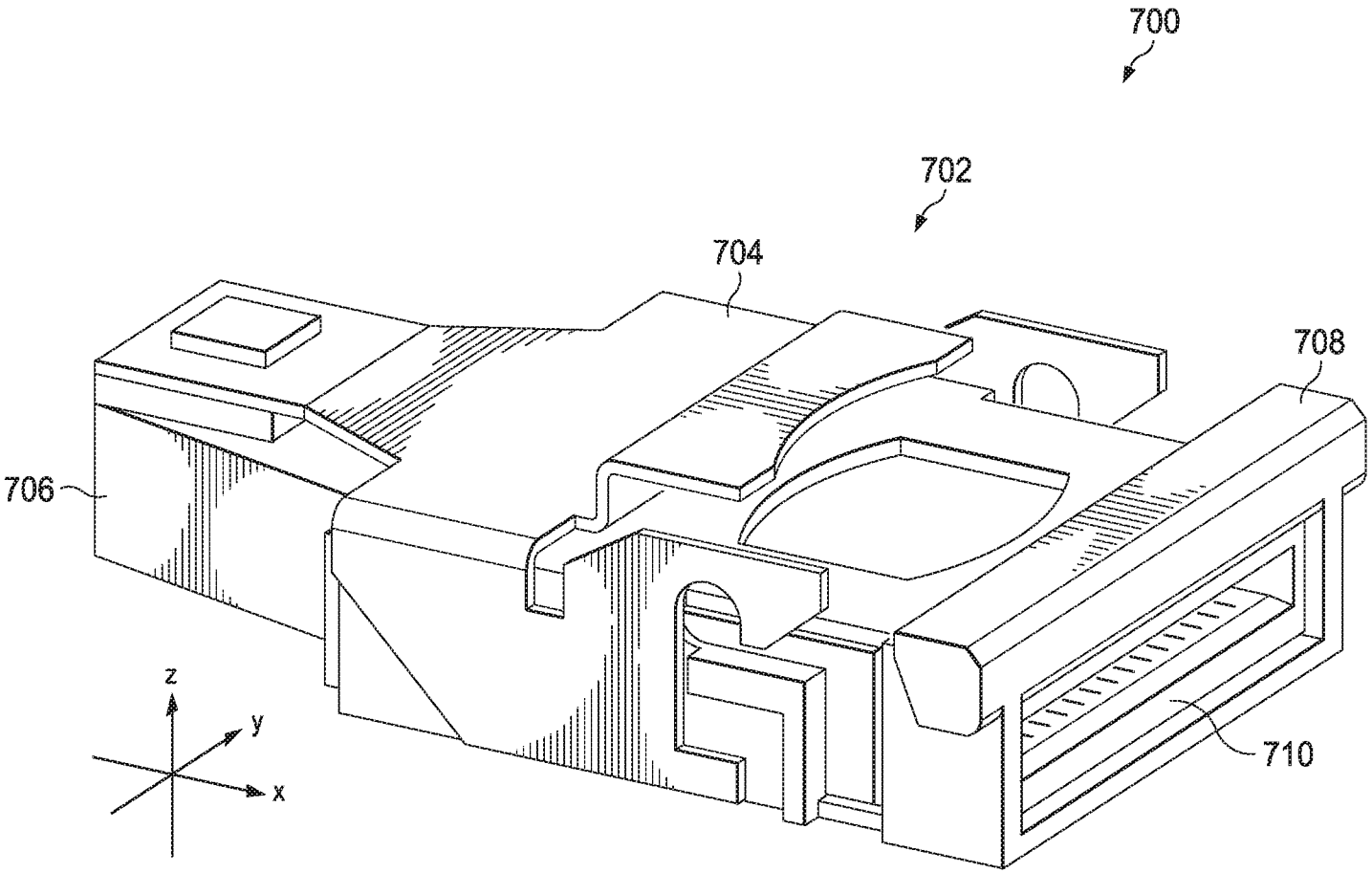
FIG. 7A is a schematic diagram of a connector assembly in accordance with embodiments of the present disclosure.

FIG. 7A is a schematic diagram 700 of a connector assembly 702 in accordance with embodiments of the present disclosure. The connector assembly 702 also utilizes the bolster plate protrusion pin design of FIG. 2. A hook retention mechanism design includes a spring loaded sleeve 704. The spring loaded sleeve 704 can be press fit on a connector body 706. The connector cap 708 is a separate plastic piece that slips over the electrical interface 710 and the connector body 706.

Figure 7B:
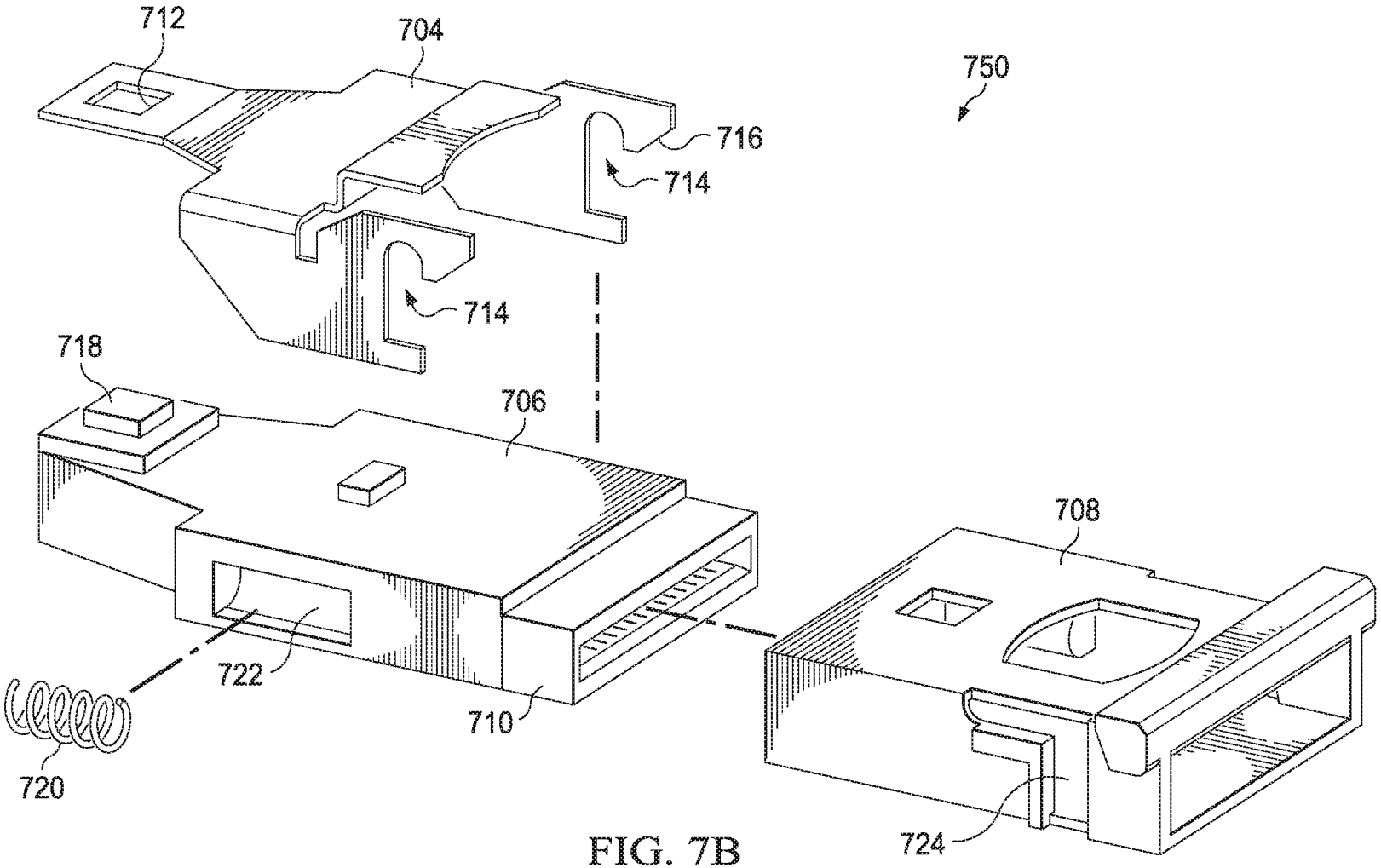
FIG. 7B is an exploded view of a schematic diagram of a connector assembly in accordance with embodiments of the present disclosure.

FIG. 7B is an exploded view of a schematic diagram 750 of a connector assembly 702 in accordance with embodiments of the present disclosure. The connector body 706 has a cutout 722 on each side to fit in the compressive springs 720. The spring loaded sleeve 704 includes a mating hole 712, which can be press fit onto a mating bump feature 718 of the connector body 706.

The spring loaded sleeve 704 can include hook features 714 configured to engage the bolster plate pin-style protrusion of FIG. 2. The hook features 714 can include an angled edge 716. The angled edge 716 can contact the bolster plate pin, which is fixed. As the connector assembly 702 is pushed onto the substrate diving board, the pin forces the hook upwards (z-direction). When the connector assembly 702 is fully pushed against the substrate diving board, the bolster pin moves into the recess of the hook 714, which falls back to its resting position, thereby locking the bolster plate pin in place.

The sleeve 708 bottoms against the substrate and works with a compressive spring 720 located in a cutout 722 on each side of the connector body 706 to provide a retention force. The plastic cap 708 bottoms against substrate 756 (shown in FIG. 7C) when the hook 714 is pulled and locked onto bolster plate pin. The compressive springs 720 can provide a controlled high retention force.

Figure 7C:
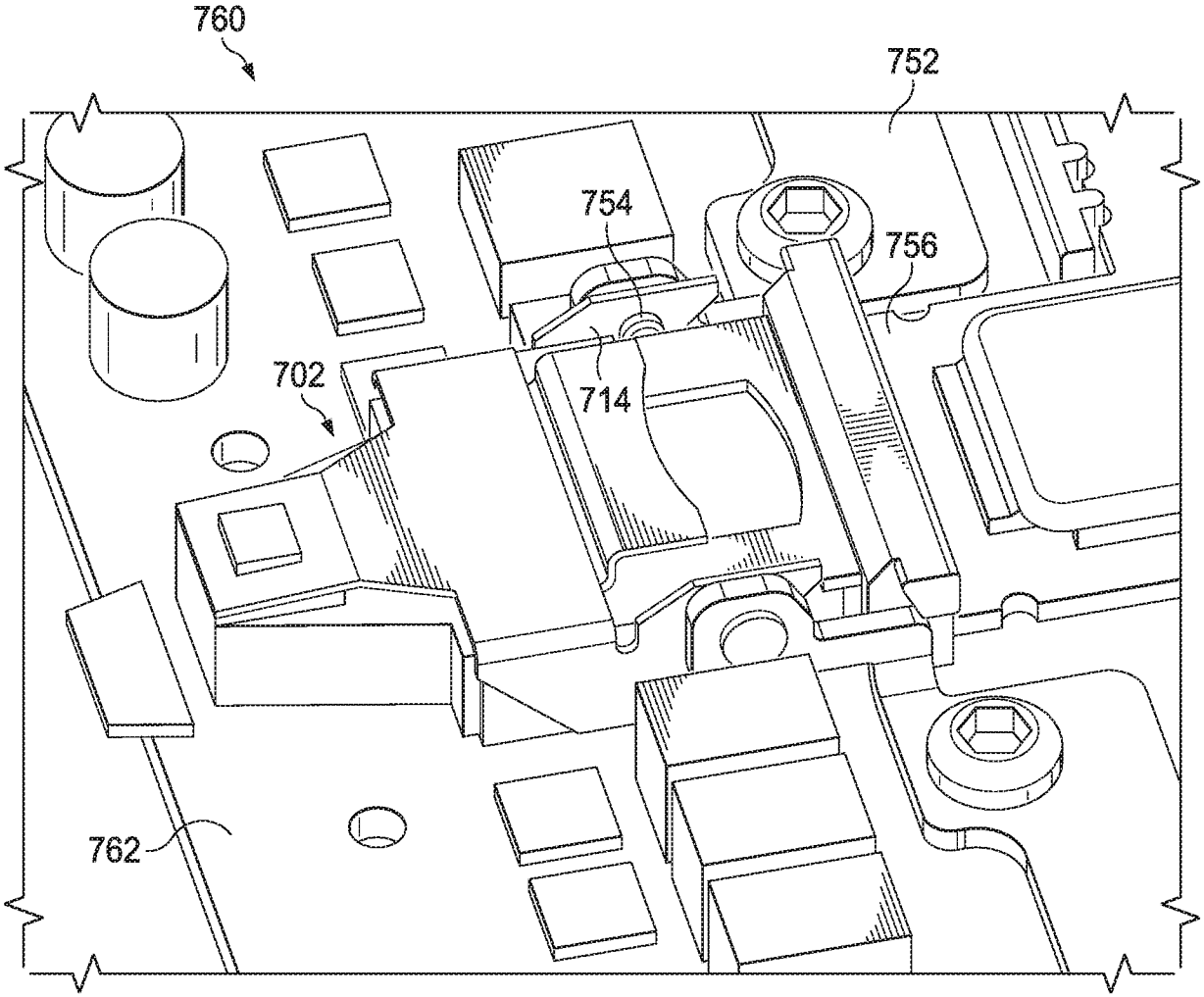
FIG. 7C is a schematic diagram of a connector assembly connected to a linear edge connector and bolster plate in accordance with embodiments of the present disclosure.

FIG. 7C is a schematic diagram 760 of a connector assembly 702 connected to a substrate diving board 756 and bolster plate 752 in accordance with embodiments of the present disclosure. During assembly, the operator can use the pull feature on the stamped metal piece 704 to pull the connector 702 toward the substrate diving board 756. When the electrical interface 710 engages the substrate diving board 756, the compressive springs 720 will start to be loaded as the connector 702 continues to translate towards the edge connector 756. The hooks 714 will engage/lock onto the bolster plate pin features 754, and push the connector 702 against substrate diving board 756 with ~4+/−0.75 lbf force along cable direction with the given compressive spring in this design which is pretty ideal for the application which balances the retention force and ergonomic force.

Figure 8:
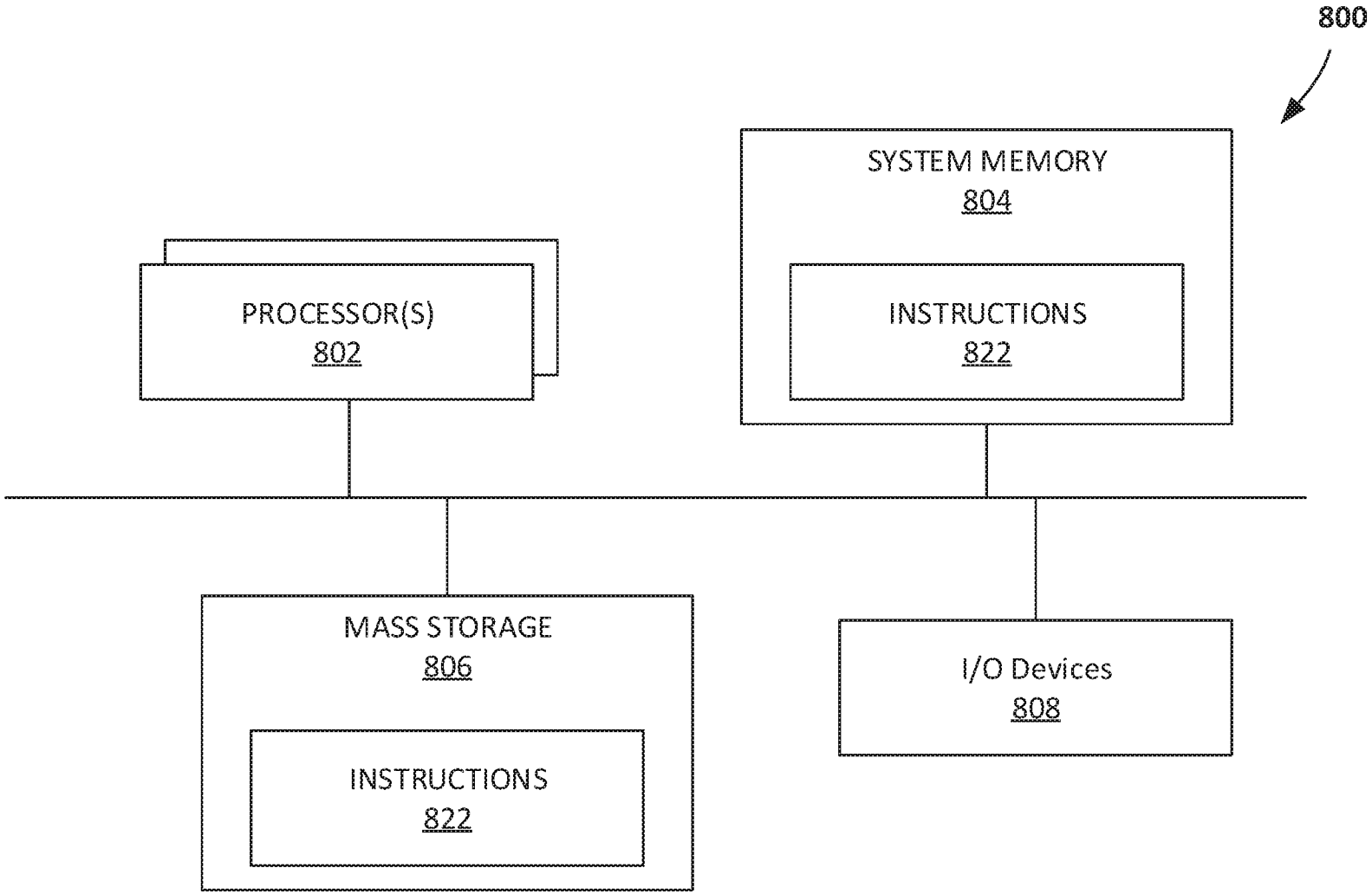
FIG. 8 is a block diagram of an example computing device that may connected via a linear edge connector.

FIG. 8 is a block diagram of an example computing device 800 that may connected via a linear edge connector. As shown, the computing device 800 may include one or more processors 802 (e.g., one or more processor cores implemented on one or more components) and a system memory 804 (implemented on one or more components). As used herein, the term "processor" or "processing device" may refer to any device or portion of a device that processes electronic data from registers and/or memory to transform that electronic data into other electronic data that may be stored in registers and/or memory. The processor(s) 802 may include one or more microprocessors, graphics processors, digital signal processors, crypto processors, or other suitable devices. More generally, the computing device 800 may include any suitable computational circuitry, such as one or more Application Specific Integrated Circuits (ASICs).

The computing device 800 may include one or more mass storage devices 806 (such as flash memory devices or any other mass storage device suitable for inclusion in a flexible IC package). The system memory 804 and the mass storage device 806 may include any suitable storage devices, such as volatile memory (e.g., dynamic random access memory (DRAM)), nonvolatile memory (e.g., read-only memory (ROM)), and flash memory. The computing device 800 may include one or more I/O devices 808 (such as display, user input device, network interface cards, modems, and so forth, suitable for inclusion in a flexible IC device). The elements may be coupled to each other via a system bus 812, which represents one or more buses.

Each of these elements may perform its conventional functions known in the art. In particular, the system memory 804 and the mass storage device 806 may be employed to store a working copy and a permanent copy of programming instructions 822.

The permanent copy of the programming instructions 822 may be placed into permanent mass storage devices 806 in the factory or through a communication device included in the I/O devices 808 (e.g., from a distribution server (not shown)). The constitution of elements 802-812 are known, and accordingly will not be further described.

The linear edge connectors disclosed herein can be used to couple any suitable computing devices, such as coupling the processor 1102 to another device (e.g., a network device), processor, Machine-accessible media (including non-transitory computer-readable storage media), methods, systems, and devices for performing the above-described techniques are illustrative examples of embodiments disclosed herein for a linear edge connector. For example, a computer-readable media (e.g., the system memory 804 and/or the mass storage device 806) may have stored thereon instructions (e.g., the instructions 822) such that, when the instructions are executed by one or more of the processors 802.

The relative sizes of features shown in the figures are not drawn to scale.

The following paragraphs provide examples of various ones of the embodiments disclosed herein.

Example 1 is a cable retention assembly comprising an electrical interface configured to receive an substrate diving board and electrically couple the substrate diving board with a linear edge connector assembly, and a retention mechanism body coupled to the electrical interface, the retention mechanism body comprising: a bolster plate receiving portion to receive a protrusion on a bolster plate, and a torsional element coupled to the retention mechanism body, the torsional element configured to contact the bolster plate to secure the cable retention assembly to the bolster plate.

Example 2 may include the subject matter of example 1 wherein the bolster plate receiving portion comprises an open portion to receive the protrusion on the bolster plate and a sidewall portion to restrict translation of the protrusion.

Example 3 may include the subject matter of any of examples 1 or 2, wherein the torsional element comprises a spring.

Example 4 may include the subject matter of any of examples 1 or 2 or 3, wherein the torsional element is configured to compress upon contact with the bolster plate.

Example 5 may include the subject matter of any of examples 1 or 2 or 3 or 4, wherein the bolster plate receiving portion comprises a notch in the retention mechanism body.

Example 6 is a cable retention assembly comprising an electrical interface configured to receive substrate diving board and electrically couple the substrate diving board with linear edge connector assembly, and a retention mechanism body. The retention mechanism body comprising: a bolster plate receiving portion to receive a protrusion on a bolster plate, and a notch configured to receive a latching element coupled to the bolster plate to secure the cable retention assembly to the bolster plate.

Example 7 may include the subject matter of example 6, wherein the bolster plate receiving portion comprises a c-shaped opening to receive the protrusion on the bolster plate.

Example 8 may include the subject matter of any of examples 6 or 7, wherein the bolster plate receiving portion is configured to align the connector body with the bolster plate upon receiving the bolster plate protrusion.

Example 9 is a cable retention assembly comprising: an electrical interface configured to receive substrate diving board and electrically couple the edge connector with a linear edge connector assembly, and a retention mechanism body coupled to the electrical interface, the retention mechanism comprising: a bolster plate receiving lever comprising a curved channel to receive a protrusion on a bolster plate, the bolster plate receiving lever configured to rotate and guide the protrusion through the curved channel; the bolster plate receiving lever further comprising a bolster plate receiving member to be received by the bolster plate, and a spring housing coupled to the bolster plate receiving lever, the spring housing configured to slide on the retention mechanism body, the spring housing comprising a spring connected to the retention mechanism body, and the spring configured to compress upon the curved channel receiving the protrusion on the bolster plate.

Example 10 may include the subject matter of example 9, wherein the curved channel comprises a cam to receive the protrusion on the bolster plate to guide the cable retention assembly onto a diving board of the edge connector.

Example 11 may include the subject matter of example 9, wherein the electrical interface comprises a sidewall to limit the linear translation of the cable retention assembly in a direction towards the edge connector.

Example 12 may include the subject matter of example 9, wherein the retention mechanism body comprises a protrusion configured to limit translation of the spring housing.

Example 13 may include the subject matter of any of examples 9 or 12, wherein the retention mechanism body comprises a slot to accommodate the spring housing and to permit the spring housing to slide on the retention mechanism body.

Example 14 may include the subject matter of any of examples 9 or 12 or 13, wherein the spring housing comprises a pin to mate with mating cam on the bolster plate receiving lever, the bolster plate receiving lever causing the spring housing to slide upon movement of the bolster plate lever.

Example 15 may include the subject matter of example 14, wherein the spring of the spring housing compresses upon translation of the cable retention assembly and provides a force opposing translation of the cable retention assembly.

Example 16 is a cable retention assembly comprising: an electrical interface configured to receive a substrate diving board and electrically couple contacts on the substrate diving board with a conductor of a cable bundle, and a retention mechanism body coupled to the electrical interface, the retention mechanism body comprising: a bolster plate receiving portion to receive a protrusion on a bolster plate, the bolster plate receiving portion comprising a hook configured to hook onto the protrusion on the bolster plate, a spring housing comprising a sidewall cutout and a spring residing in the sidewall cutout, the bolster plate receiving portion coupled to the spring housing, and a sleeve between the bolster plate receiving portion and the spring housing, the sleeve configured to slide on the spring housing, the sleeve comprising an extrusion in contact with the spring and configured to compress the spring.

Example 17 may include the subject matter of example 16, wherein the bolster plate receiving portion comprises stamped steel.

Example 18 may include the subject matter of example 16, wherein the bolster plate receiving portion comprises a cutout on one end to receive a mating protrusion on the spring housing, the mating of the cutout and the mating protrusion mating the bolster plate receiving portion with the spring housing.

Example 19 may include the subject matter of example 16, wherein the sleeve residing between the spring housing the bolster plate receiving portion is configured to contact the protrusion and is configured to guide the protrusion on the bolster plate to mate with the hook on the bolster plate receiving portion.

Example 20 may include the subject matter of example 16, wherein the hook is configured to deflect upon contact with the protrusion on the bolster plate to allow the hook to capture the protrusion.

Example 21 is a computing system comprising: a central processing unit (CPU) residing on a circuit board, the circuit board comprising an edge connector electrically coupled to the CPU; a bolster plate mechanically connected the circuit board, the bolster plate comprising a connector receiving element comprising a protrusion; and a cable cable retention assembly comprising: an electrical interface configured to receive the edge connector and electrically couple the edge connector to a wiring connector assembly, and a retention mechanism body coupled to the electrical interface, the retention mechanism body comprising: a bolster plate receiving portion to receive a protrusion on a bolster plate, and a torsional element coupled to the retention mechanism body, the torsional element configured to contact the bolster plate to secure the cable retention assembly to the bolster plate.

Example 22 is a computing system comprising: a central processing unit (CPU) residing on a circuit board, the circuit board comprising an edge connector electrically coupled to the CPU; a bolster plate mechanically connected the circuit board, the bolster plate comprising a connector receiving element comprising a protrusion; and a cable retention assembly comprising: an electrical interface configured to receive an edge connector and electrically couple the edge connector with a wiring connector assembly, and a retention mechanism body comprising: a bolster plate receiving portion to receive a protrusion on a bolster plate, and a notch configured to receive a latching element coupled to the bolster plate to secure the cable retention assembly to the bolster plate.

Example 23 is a computing system comprising: a central processing unit (CPU) residing on a circuit board, the circuit board comprising an edge connector electrically coupled to the CPU; a bolster plate mechanically connected the circuit board, the bolster plate comprising a connector receiving element comprising a protrusion; and a cable retention assembly comprising: an electrical interface configured to receive an edge connector and electrically couple the edge connector with a wiring connector assembly, and a retention mechanism body coupled to the electrical interface, the retention mechanism body comprising: a bolster plate receiving portion to receive a protrusion on a bolster plate, the bolster plate receiving portion comprising a hook on the bolster plate receiving portion configured to hook onto the protrusion on the bolster plate, a spring housing comprising a sidewall cutout and a spring residing in the sidewall cutout, the bolster plate receiving portion coupled to the spring housing, the electrical interface received within an end of the spring housing, the electrical interface contacting the spring.

Example 24 is a computing system comprising: a central processing unit (CPU) residing on a circuit board, the circuit board comprising an edge connector electrically coupled to the CPU; a bolster plate mechanically connected the circuit board, the bolster plate comprising a connector receiving element comprising a protrusion; and a cable retention assembly comprising: an electrical interface configured to receive an edge connector and electrically couple the edge connector with a wiring connector assembly, and a retention mechanism body coupled to the electrical interface, the retention mechanism body comprising: a bolster plate receiving portion to receive a protrusion on a bolster plate, the bolster plate receiving portion comprising a hook on the bolster plate receiving portion configured to hook onto the protrusion on the bolster plate, and a spring housing comprising a sidewall cutout and a spring residing in the sidewall cutout, the bolster plate receiving portion coupled to the spring housing, the electrical interface received within an end of the spring housing, the electrical interface contacting the spring, and a sleeve between the bolster plate receiving portion and the spring housing, the sleeve configured to slide on the spring housing, the sleeve comprising an extrusion in contact with the spring and configured to compress the spring.

Example 25 may include the subject matter of example 21, wherein the bolster plate receiving portion comprises an open portion to receive the protrusion on the bolster plate and a sidewall portion to restrict translation of the protrusion.

Example 26 may include the subject matter of example 21, wherein the torsional element comprises a spring.

Example 27 may include the subject matter of example 21, wherein the torsional element is configured to compress upon contact with the bolster plate.

Example 28 may include the subject matter of example 21, wherein the bolster plate receiving portion comprises a notch in the retention mechanism body.

Example 29 may include the subject matter of example 22, wherein the bolster plate receiving portion comprises a c-shaped opening to receive the protrusion on the bolster plate.

Example 30 may include the subject matter of example 22, wherein the bolster plate receiving portion is configured to align the connector body with the bolster plate upon receiving the bolster plate protrusion.

Example 31 may include the subject matter of example 23, wherein the curved channel comprises a cam to receive the protrusion on the bolster plate to guide the cable retention assembly onto a diving board of the edge connector.

Example 32 may include the subject matter of example 23, wherein the electrical interface comprises a sidewall to limit the linear translation of the cable retention assembly in a direction towards the edge connector.

Example 33 may include the subject matter of example 23, wherein the retention mechanism body comprises a protrusion configured to limit translation of the spring housing.

Example 34 may include the subject matter of examples 23 or 33, wherein the retention mechanism body comprises a slot to accommodate the spring housing and to permit the spring housing to slide on the retention mechanism body.

Example 35 may include the subject matter of examples 31 or 33 or 34, wherein the spring housing comprises a pin to mate with mating cam on the bolster plate receiving lever, the bolster plate receiving lever causing the spring housing to slide upon movement of the bolster plate lever.

Example 36 may include the subject matter of example 35, wherein the spring of the spring housing compresses upon translation of the cable retention assembly and provides a force opposing translation of the cable retention assembly.

Example 37 may include the subject matter of example 24, wherein the bolster plate receiving portion comprises stamped steel.

Example 38 may include the subject matter of example 24, wherein the bolster plate receiving portion comprises a cutout on one end to receive a mating protrusion on the spring housing, the mating of the cutout and the mating protrusion mating the bolster plate receiving portion with the spring housing.

Example 39 may include the subject matter of example 24, wherein the sleeve residing between the spring housing the bolster plate receiving portion is configured to contact the protrusion and is configured to guide the protrusion on the bolster plate to mate with the hook on the bolster plate receiving portion.

Example 40 may include the subject matter of example 24, wherein the hook is configured to deflect upon contact with the protrusion on the bolster plate to allow the hook to capture the protrusion.

Example 41 may include the subject matter of example 24, wherein the bolster plate receiving portion comprises a cutout on one end to receive a mating protrusion on the spring housing, the mating of the cutout and the mating protrusion mating the bolster plate receiving portion with the spring housing.

What is claimed is:

1. A cable retention assembly, comprising:

an electrical interface to receive a substrate diving board and electrically couple the substrate diving board with a linear edge connector assembly; and a retention mechanism body coupled to the electrical interface, the retention mechanism body comprising:

a bolster plate receiving portion to receive a protrusion on a bolster plate, and a torsional element coupled to the retention mechanism body, the torsional element to contact the bolster plate to secure the cable retention assembly to the bolster plate.

2. The cable retention assembly of claim 1, wherein the bolster plate receiving portion comprises an open portion to receive the protrusion on the bolster plate and a sidewall portion to restrict translation of the protrusion.

3. The cable retention assembly of claim 1, wherein the torsional element comprises a spring.

4. The cable retention assembly of claim 1, wherein the torsional element is to compress upon contact with the bolster plate.

5. The cable retention assembly of claim 1, wherein the bolster plate receiving portion comprises a notch in the retention mechanism body.

6. A computing system, comprising:

a central processing unit (CPU) residing on a substrate, the substrate comprising a diving board comprising contacts coupled to the CPU;

a bolster plate mechanically connected to the substrate, the bolster plate comprising a connector receiving element comprising a protrusion; and a cable retention assembly comprising:

an electrical interface to electrically couple the substrate to a wiring connector assembly, and a retention mechanism body coupled to the electrical interface, the retention mechanism body comprising:

a bolster plate receiving portion to receive the protrusion on the bolster plate, and a torsional element coupled to the retention mechanism body, the torsional element to contact the bolster plate to secure the cable retention assembly to the bolster plate.

* * * * *